US007779938B2

(12) United States Patent
Barbera

(10) Patent No.: US 7,779,938 B2
(45) Date of Patent: Aug. 24, 2010

(54) SWIVEL FOR USE IN INSTALLING LARGE DIAMETER CASING

(76) Inventor: James S. Barbera, 1635 37th St. NW., Canton, OH (US) 44709

( * ) Notice: Subject to any disclaimer, the term of this patent is extended or adjusted under 35 U.S.C. 154(b) by 46 days.

(21) Appl. No.: 11/715,134

(22) Filed: Mar. 7, 2007

(65) Prior Publication Data

US 2008/0217068 A1 Sep. 11, 2008

(51) Int. Cl.

| | |
|---|---|
| ***E21B 10/00*** | (2006.01) |
| ***E21B 10/25*** | (2006.01) |
| ***E21B 17/04*** | (2006.01) |
| ***E21B 17/05*** | (2006.01) |

(52) U.S. Cl. ..... 175/388; 175/323; 175/394; 175/385

(58) Field of Classification Search ..... 175/62, 175/323, 394, 385, 388; 384/613, 619; 403/296, 403/298, 306, 305

See application file for complete search history.

(56) References Cited

U.S. PATENT DOCUMENTS

| | | | | |
|---|---|---|---|---|
| 1,932,068 | A * | 10/1933 | Englebright et al. | 173/24 |
| 3,162,254 | A * | 12/1964 | Rose | 173/148 |
| 3,194,618 | A * | 7/1965 | Hamaker | 384/619 |
| 4,117,895 | A * | 10/1978 | Ward et al. | 175/53 |
| 5,314,267 | A * | 5/1994 | Osadchuk | 405/184 |
| 6,206,109 | B1 | 3/2001 | Monier et al. | |
| 6,682,264 | B1 * | 1/2004 | McGillis | 405/184 |
| 6,827,158 | B1 * | 12/2004 | Dimitroff et al. | 175/62 |
| 2003/0150648 | A1 * | 8/2003 | Kelm | 175/394 |
| 2004/0035572 | A1 * | 2/2004 | Cooper | 166/77.51 |

FOREIGN PATENT DOCUMENTS

| | | | |
|---|---|---|---|
| SU | 863831 B | * | 9/1981 |

* cited by examiner

*Primary Examiner*—Shane Bomar
*Assistant Examiner*—Cathleen R Hutchins
(74) *Attorney, Agent, or Firm*—Sand & Sebolt

(57) ABSTRACT

The invention includes a pair of swivels for use with an auger boring machine. One of the swivels allows for rotation of a first auger of a first auger assembly connected to the trailing end of a pilot tube without rotating the pilot tube. The other swivel allows for rotation of a larger diameter second auger connected to the trailing end of the first auger assembly without rotating the first auger. Each of the swivels includes a thrust bearing.

32 Claims, 19 Drawing Sheets

SWIVEL FOR USE IN INSTALLING LARGE DIAMETER CASING

BACKGROUND OF THE INVENTION

1. Technical Field

The invention relates generally to an auger boring machine and a method of use in the trenchless installation of underground pipe. More particularly, the invention relates to such a machine which utilizes a pilot tube for forming a pilot hole for guiding smaller and larger diameter augers of the machine. Specifically, the invention relates to a swivel between the pilot tube and smaller diameter auger and a swivel between the smaller and large diameter augers.

2. Background Information

The use of an auger boring machine for installing underground pipe between two locations without digging a trench there between is broadly known. In addition, it is known to use a pilot tube formed of a plurality of pilot tube segments to create a pilot hole for guiding an auger which bores a larger hole so that the auger remains within a reasonably precise line and grade. For example, see U.S. Pat. No. 6,206,109 granted to Monier et al. An enormous amount of force is involved in driving the pilot tube and in rotating the augers. During the driving of the pilot tube, the pilot tube is rotatable to provide steering in order to keep the pilot tube on a reasonably accurate line and grade. However, once the pilot hole is completed, there is no longer a need to rotate the pilot tube and continuing such rotation substantially adds to the amount of force required in the auger boring process. Similarly, once it is time for the larger diameter auger and cutting head to begin cutting the larger diameter hole, there is no need to continue rotation of the smaller diameter auger which likewise requires additional force. The present invention solves this and other problems in the art.

BRIEF SUMMARY OF THE INVENTION

The present invention provides an apparatus comprising a swivel comprising first and second sections mounted on one another with relative rotation therebetween; the first section being adapted to mount on a first auger assembly comprising a first cutting head and a first auger mounted thereon; and the second section being adapted to mount on one of a pilot tube having a diameter smaller than that of the first auger assembly and a second auger assembly having a diameter larger than that of the first auger assembly and comprising a cylindrical casing, a second cutting head and a second auger mounted on the second cutting head and rotatably disposed in the casing.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
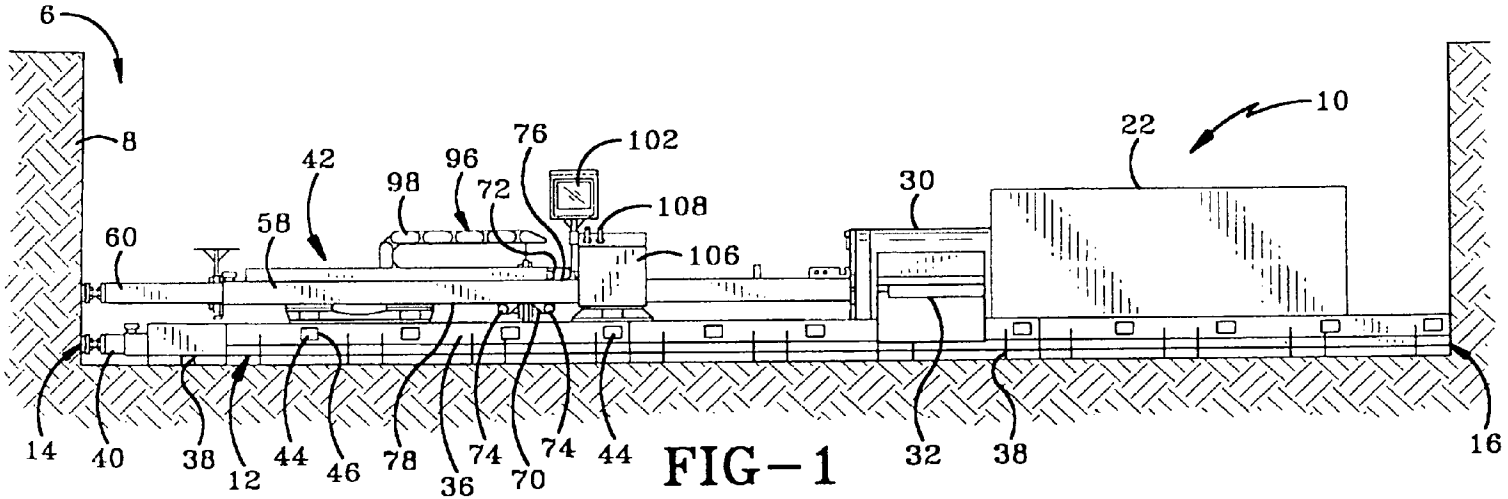
FIG. 1 is a side elevational view of the auger boring machine of the present invention shown in a pit formed in the earth.
Figure 2:
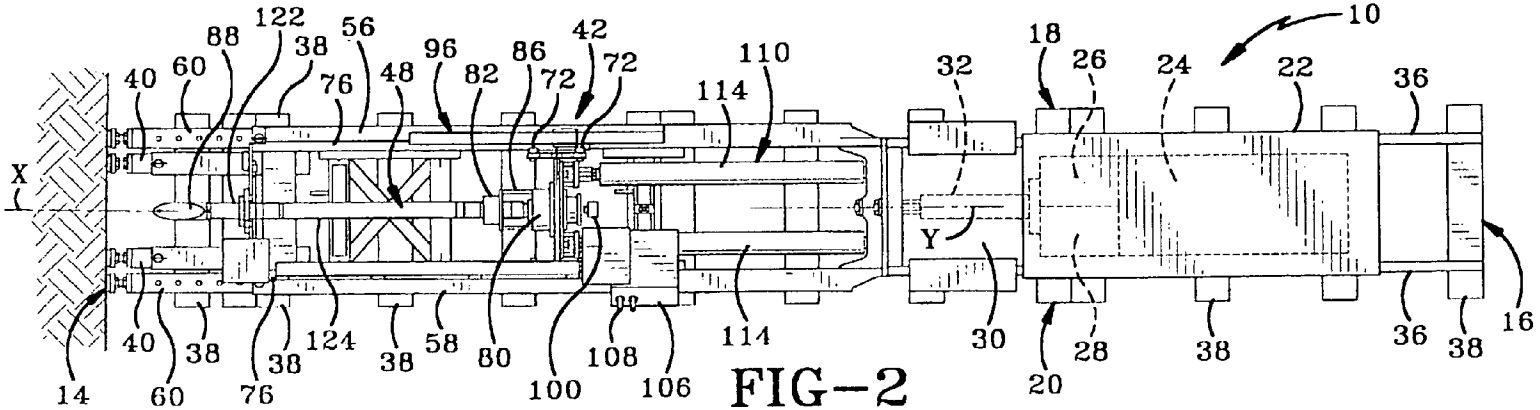
FIG. 2 is a top plan view of the auger boring machine.

The auger boring machine of the present invention is indicated generally at 10 in FIGS. 1 and 2. Referring to FIG. 1, machine 10 is typically disposed in a pit 6 formed in the earth's soil or ground 8 and configured to bore a hole through ground 8 for the purpose of laying underground pipe in the bored hole. Machine 10 typically bores a hole from within a pit such as pit 6 to another pit which may be spaced several hundred feet away. Machine 10 includes a frame 12 which extends from a front end 14 to a rear end 16 of machine 10. Front and rear end 14 and 16 define there between an axial direction of machine 10. Machine 10 further has first and second opposed sides 18 and 20 (FIG. 2) defining there between a lateral direction of machine 10.

Figure 25:
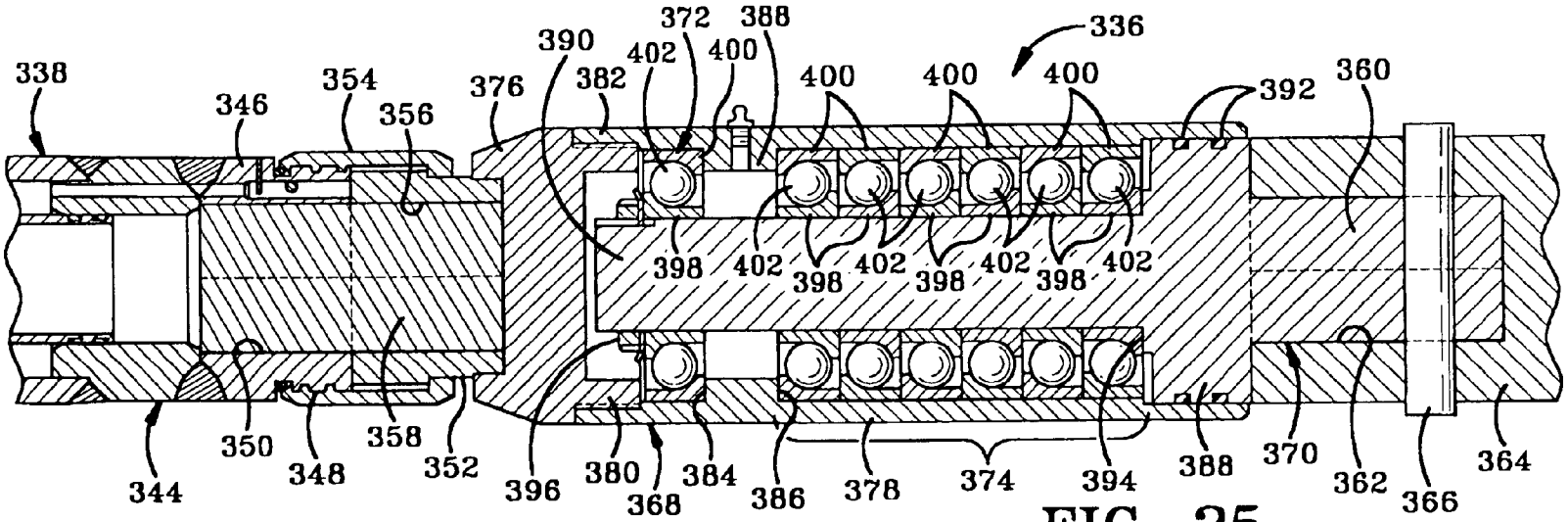
FIG. 25 is a sectional view taken on line 25-25 of FIG. 24 showing the second embodiment of the swivel and its respective connections with the trailing end of the pilot tube and the leading end of the shock rod.

An engine compartment 22 is mounted on frame 12 and houses therein a fuel powered engine 24, an electric generator 26 powered by engine 24 and a hydraulic pump 28 also powered by engine 24. An auger drive compartment 30 is disposed in front of compartment 22 and houses therein an auger drive having a rotational output shaft 32 for rotationally driving an auger 34 (FIG. 25). Frame 12 further includes a pair of spaced longitudinally extending rails 36 secured to a plurality of cross bars 38 which are mounted on ground 8 in the bottom of pit 6. A pair of adjustable stabilizing poles 40 are telescopically received in and adjustably mounted respectively on rails 36 and configured to press against the wall of ground 8 which bounds pit 6.

A pilot tube guidance and drive assembly 42 is removably mounted on frame 12 and more particularly on rails 36 via mounting legs 44 (FIG. 3) which are removably insertable into openings 46 formed in each of rails 36. Mounting legs 44 and the mounting mechanism of which they are a part are described in further detail in the copending application entitled Pilot Tube System And Attachment Mechanism for Auger Boring Machine which is incorporated herein by reference and filed concurrently herewith. Assembly 42 when mounted on frame 12 is positioned so that a central axially extending axis X of a pilot tube 48 is coaxial with an axially extending axis Y which passes centrally through output shaft 32 and about which shaft 32 is rotated when driving auger 34. Assembly 42 includes a generally circular rear plate 50 which abuts compartment 30 when assembly 42 is mounted on frame 12 and includes a portion which is inserted into compartment 30 to assist with the alignment of assembly 42.

Assembly 42 includes front and rear mounting assemblies 52 and 54 which also serve as supports providing rigid structure extending laterally across the width of assembly 42. Assemblies 52 and 54 are seated on rails 36 of frame 12 when assembly 42 is mounted on frame 12. A pair of axially extending parallel spaced rails 56 and 58 are rigidly mounted on assemblies 52 and 54 and extend along most of the length of assembly 42. Adjustable stabilizing poles 60 are telescopically mounted respectively within first and second rails 56 and 58 and are adjustable to provide force against ground 8 in the same manner as poles 40.

Figure 3:
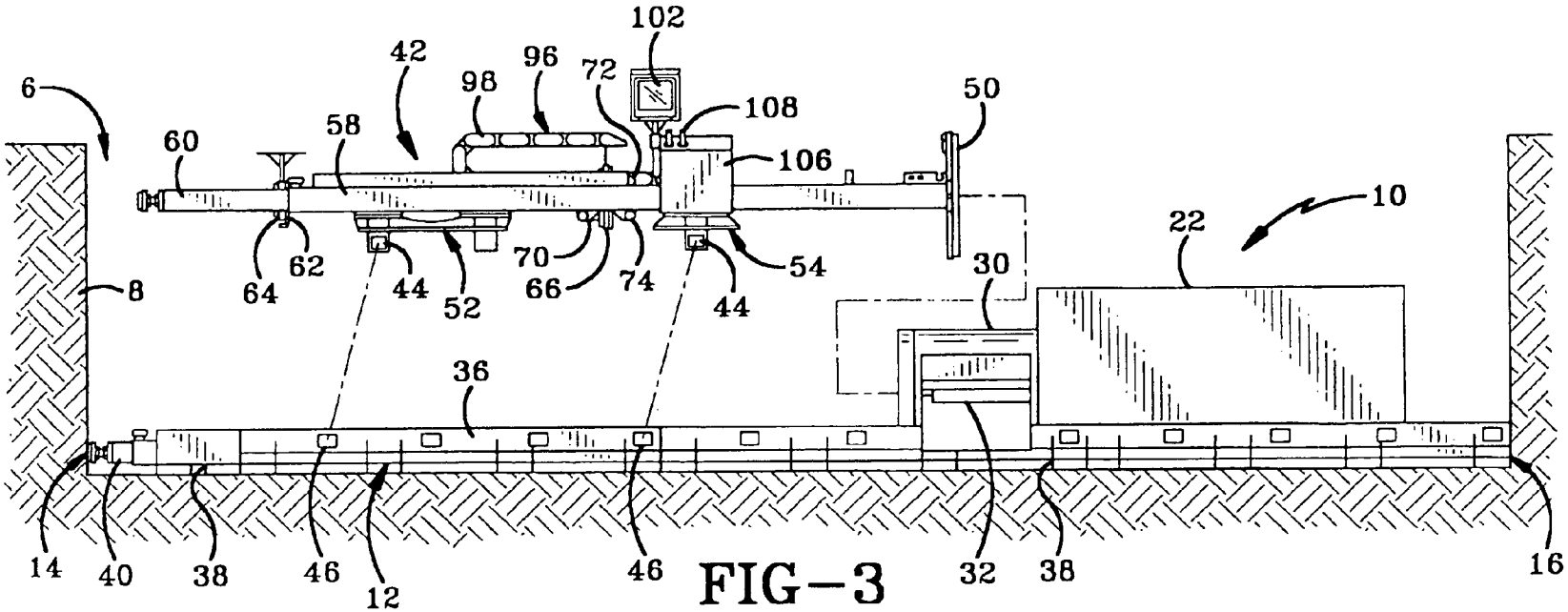
FIG. 3 is a side elevational view similar to FIG. 1 showing the pilot tube drive assembly removed from the frame of the boring machine.

A rigid front cross member 62 extends between and is connected to each of rails 56 and 58 adjacent the front thereof with a front pilot tube support 64 mounted thereon centrally between rails 56 and 58. Support 64 includes a plurality of bearings which engage the pilot tube 48 to allow axial movement of tube 48 as well as rotational movement of tube 48 about axis X to allow for the steering thereof. Rear plate 50 and associated structure attached thereto serve as a rear cross member for rigidly connecting rails 56 and 58 to one another at the rear of assembly 42. An intermediate cross member 66 extends laterally between rails 56 and 58 and is supported respectively on rails 56 and 58 by first and second roller assemblies 68 and 70 (FIGS. 1 and 3). Each roller assembly includes a pair of upper rollers 72 and lower rollers 74 which respectively rollingly engage upper and lower parallel surfaces 76 and 78 of respective rails 56 and 58.

An electric guidance control motor 80 is mounted on cross member 66 for selectively rotating pilot tube 48 in either direction about axis X. A lubricant feed swivel 82 having a lubricant inlet 84 is mounted on motor 80 by a pair of spaced mounting rods 86. Swivel 82 serves as an engaging member for drivingly engaging tube 48 during operation of assembly 42. Inlet 84 of swivel 82 is in fluid communication with a lubricant feedline which is in fluid communication with a source of lubricant, which is typically water. Swivel 82 receives water through inlet 84 to pump the water through pilot tube 48 and through a steering head 88 connected to the front of pilot tube 48, the water flowing out a forward exit opening 90 and a plurality of lateral exit openings 92. A cord carrier 96 includes a plurality of links 98 which are pivotally connected to one another so that electrical cords (not shown) for powering motor 80 will not become tangled during the driving of pilot tube 48.

Figure 4:
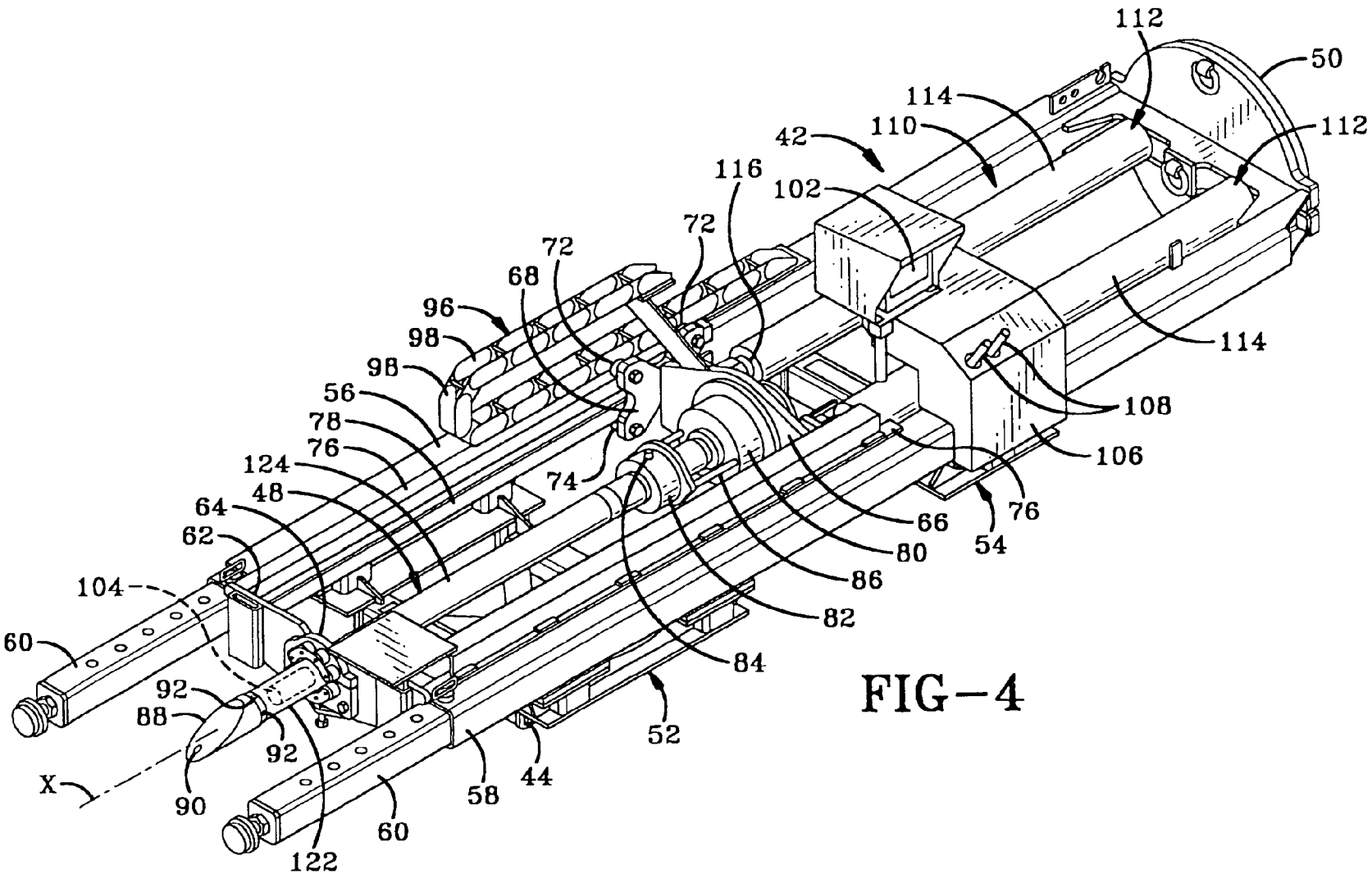
FIG. 4 is a perspective view of the drive assembly.

During the driving of pilot tube 48, a steering mechanism keeps tube 48 on line and grade using a theodolite which utilizes a camera 100 in electrical communication with a display monitor 102 which displays the view of the camera through pilot tube 48 of an illuminated LED target 104 (FIG. 4) disposed within pilot tube 48 adjacent steering head 88. In order for camera 100 to view LED target 104, pilot tube 48 is hollow, as are the other structures intermediate camera 100 and target 104, such as motor 80 and swivel 82, in order to provide a line of sight Z (FIGS. 5, 9, 13) between camera 100 and target 104. A guidance control unit 106 is mounted on rail 58 and includes manually operable controls 108 in electrical communication with motor 80 in order to send a signal to motor 80 to control rotation of pilot tube 48.

Assembly 42 includes a drive mechanism 110 comprising a pair of hydraulic piston-cylinder combinations 112 which are powered by pump 28 and provide a substantial amount of forward and reverse thrust. For example, the forward thrust produced by combinations 112 on one preferred embodiment has a maximum thrust of 280,000 pounds while the reverse thrust has a maximum thrust of 140,000 pounds. Drive mechanism 110 is described in greater detail in the copending application entitled Method And Apparatus For Providing A Continuous Stroke Auger Boring Machine which is incorporated herein by reference and filed concurrently herewith.

Pilot tube 48 is made up of a plurality of pilot tube segments which are connected end to end to sequentially increase the length of pilot tube 48 during the driving process. Pilot tube 48 includes lead pilot tube segment 122, which houses target 104, is connected to steering head 88 and is shorter than the standard pilot tube segments 124 connected sequentially behind segment 122.

Figure 5:
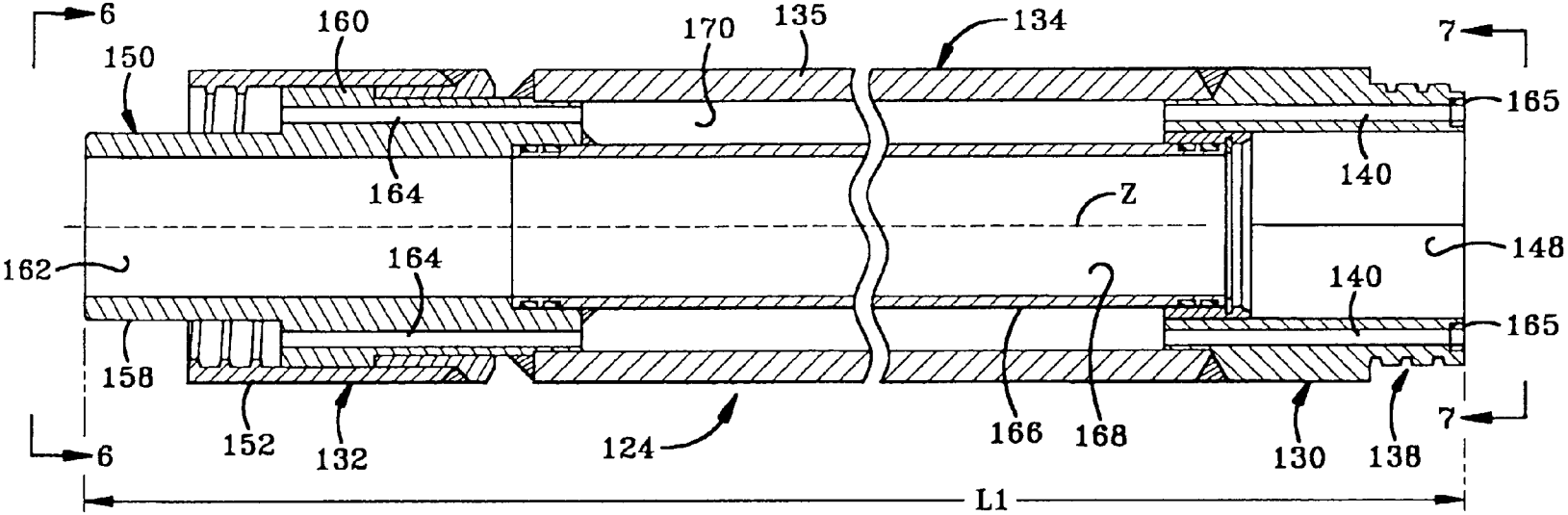
FIG. 5 is a fragmentary sectional view taken along the longitudinal axis of a pilot tube segment showing the internal structure thereof and the coupling members.
Figure 7:
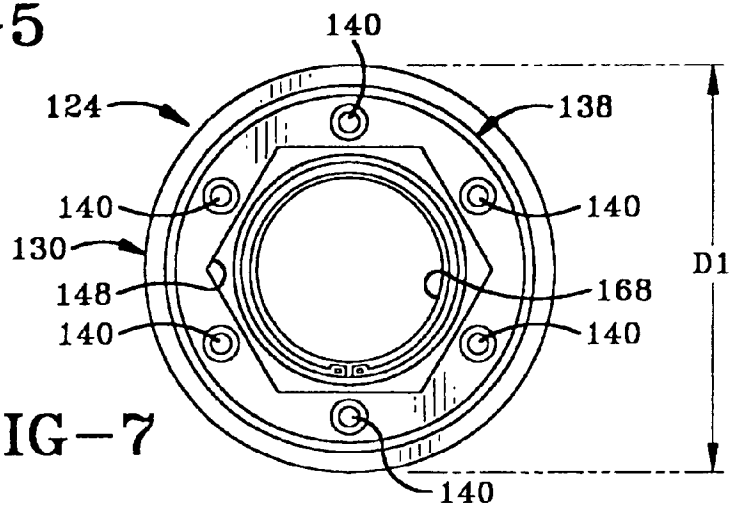
FIG. 7 is an end elevational view taken on line 7-7 of FIG. 5 showing the other coupling member.
Figure 6:
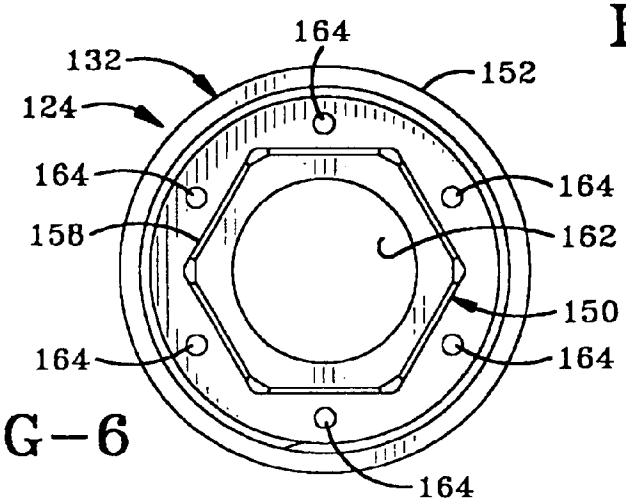
FIG. 6 is an end elevational view taken on line 6-6 of FIG. 5 showing one of the coupling members.

As noted previously, pilot tube 48 is configured to allow a lubricant such as water to flow therethrough to steering head 88. With reference to FIGS. 5-7, segment 124 has first and second coupling members 130 and 132 having a mating configuration with one another so that a first coupling member 130 of tube segment 124 may be coupled to a second coupling member 132 of another tube segment 124 to form pilot tube 48 during the process of driving the pilot tube. Members 130 and 132 are respectively connected at either end of a central section 134, which includes an outer pipe 135 and an inner pipe 166 defining therebetween an annular passage 170. Each of outer pipe 135 and coupling members 130 and 132 have an outer diameter D1 (FIG. 7) which is the diameter of pilot tube 48. First coupling member 130 includes an externally threaded end portion 138. Six lubricant passages 140 are formed in first coupling member 130 and communicate with passage 170. A central hexagonal opening 148 extends inwardly from the trailing end of member 130.

Second coupling member 132 includes an inner member 150 and an internally threaded collar 152 rotatably mounted on inner member 150 and configured to threadably engage the threaded portion 138 of a coupling member 130 of another pilot tube segment 124. Inner member 150 includes a hexagonal segment 158 which is receivable within and has a mating configuration with hexagonal opening 148 of first coupling member 130. Inner member 150 includes an annular wall 160 and defines a central passage 162 and six lubricant passages 164 communicating with passage 170 and arranged to align with passages 140 when a first and second coupling member 130 and 132 are joined to one another. Passages 140, 164 and 170 thus form a lubricant through passage in tube segment 124 extending from adjacent its leading end to adjacent its trailing end.

Figure 9:
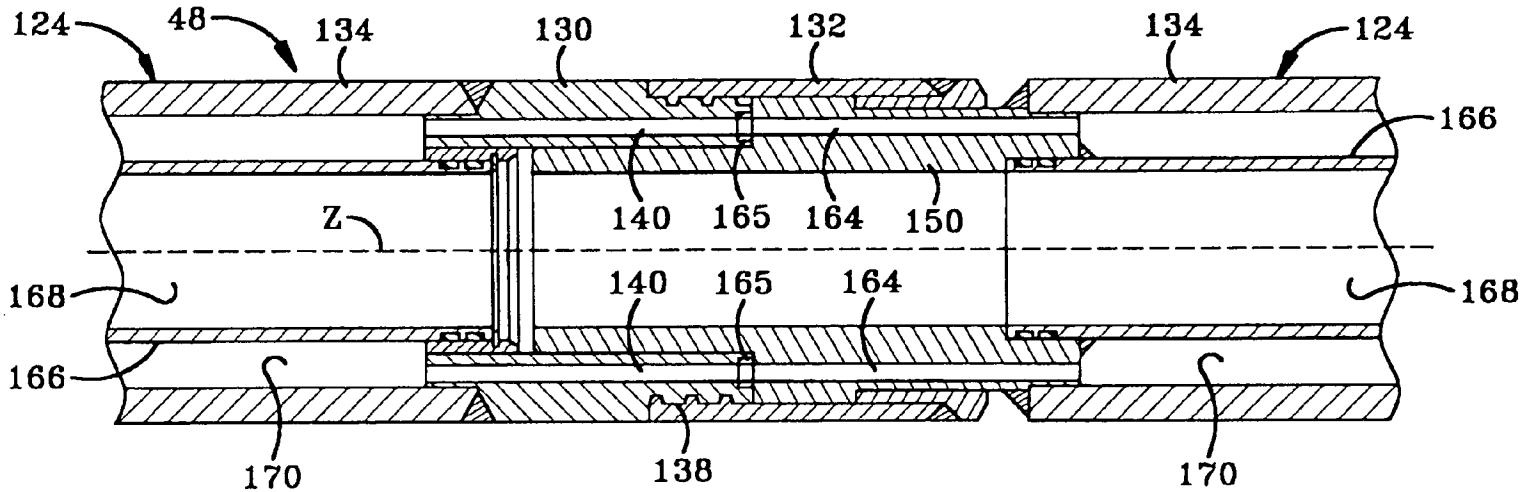
FIG. 9 is a sectional view taken on line 9-9 of FIG. 8 showing the connection between the pilot tube segments via the connection of the coupling members.

Inner pipe 166 defines a central passage 168 which communicates with passage 162 and opening 148 so that a through passage is formed in segment 124 to provide for line of sight Z. FIG. 9 shows two pilot tube segments 124 connected via the coupling of members 130 and 132 via the threaded engagement there between. Passages 140 are aligned respectively with passages 164 with seals 165 therebetween. The lubrication system of assembly 42 is described in further detail in the copending application entitled Lubricated Pilot Tubes For Use With Auger Boring Machine Pilot Steering System which is incorporated herein by referenced and filed concurrently herewith.

Figure 8:
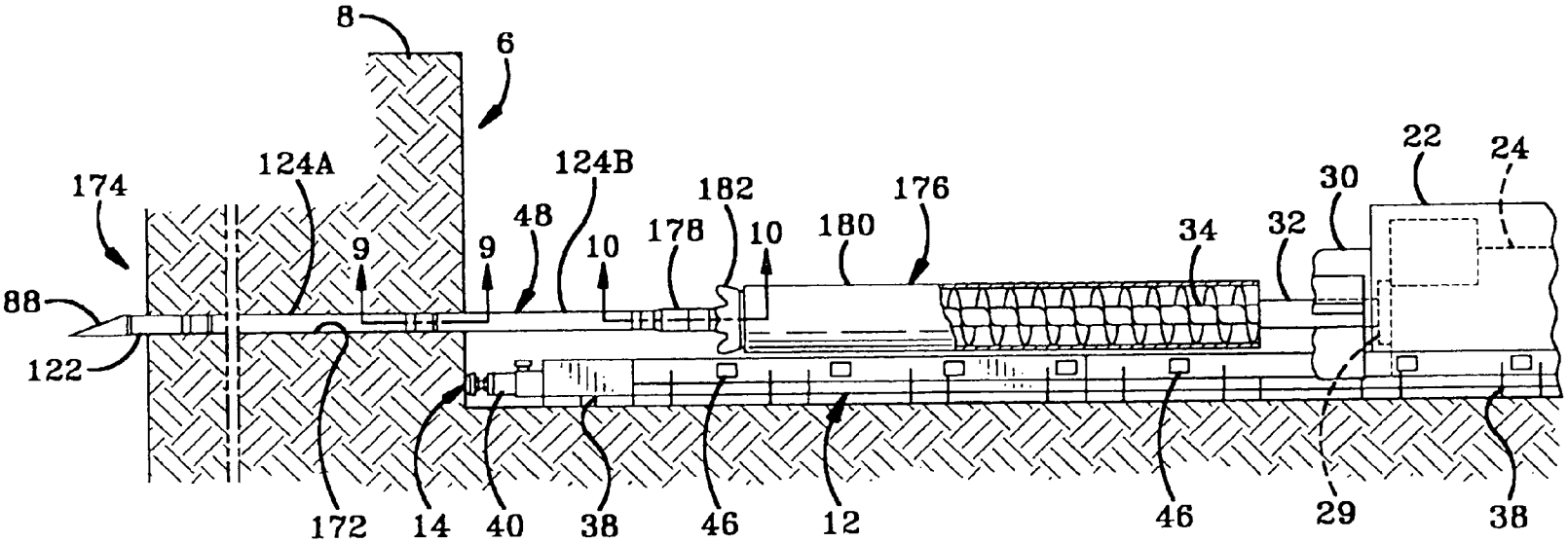
FIG. 8 is a side elevational view of the auger boring machine showing the smaller diameter auger assembly mounted on the pilot tube by the first swivel.
Figure 11:
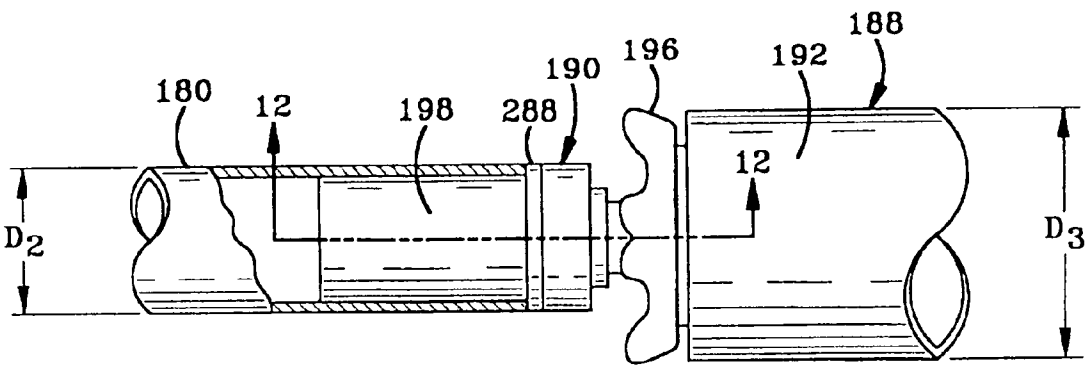
FIG. 11 is an enlarged fragmentary view of the second swivel connected to each of the smaller and larger diameter auger assemblies.

FIG. 8 shows machine 10 with drive assembly 42 removed therefrom subsequent to pilot tube 48 having been driven to form a pilot hole 172 extending from pit 6 to another open space such as pit 174. FIG. 8 also shows that pilot tube 48 includes a first pilot tube segment 124A and a second pilot tube segment 124B connected thereto. In addition, a first smaller diameter auger assembly 176 is mounted on pilot tube 48 via a first swivel 178 disposed therebetween. Auger assembly 176 has a diameter D2 (FIG. 11) which is substantially larger than diameter D1 (FIG. 7) of pilot tube 48. Assembly 176 includes a cylindrical casing 180, auger 34 disposed therein and a cutting head 182 mounted on the leading end of auger 34 and rotatable therewith. Auger 34 is mounted on drive 32 so that FIG. 8 shows machine 10 in preparation for boring a hole with cutting head 182 which is larger than pilot hole 172.

Figure 8A:
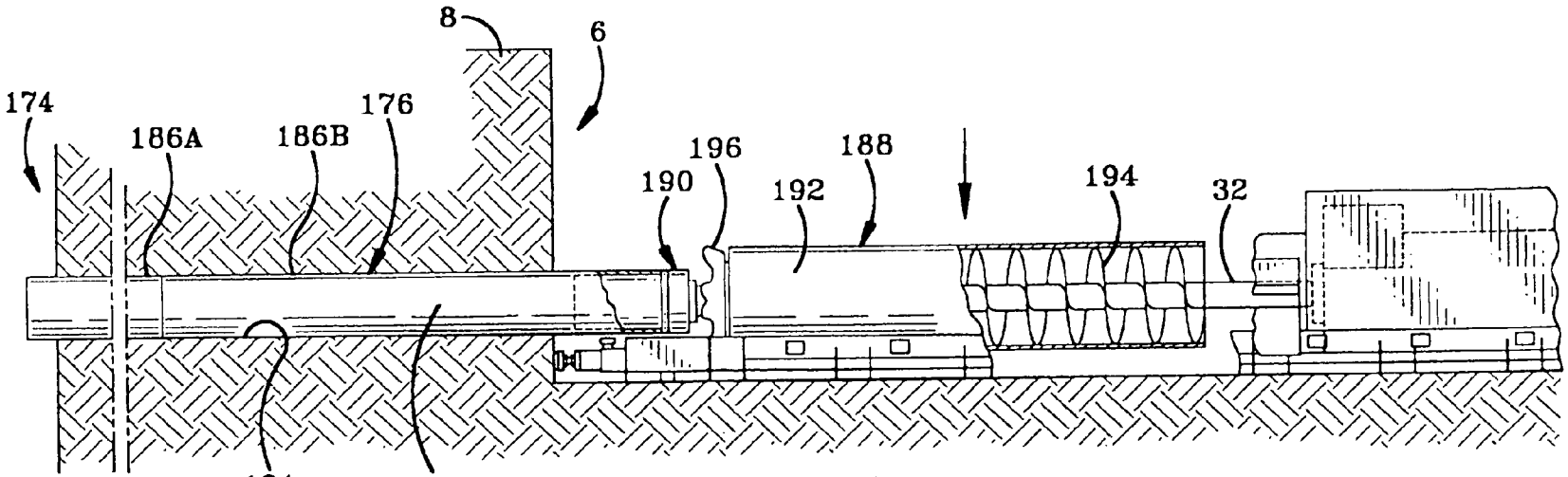
FIG. 8A is similar to FIG. 8 and shows the larger diameter auger assembly mounted on the smaller diameter auger assembly by the second swivel.

FIG. 8A shows machine 10 having been operated so that auger assembly 176 has formed such a larger diameter intermediate hole 184 in soil 8. FIG. 8A also shows that auger assembly 176 includes first and second segments 186A and 186B connected thereto. A larger second auger assembly 188 is mounted on the trailing end of first auger assembly 176 via a second swivel 190. Assembly 188 has a diameter D3 (FIG. 11) which is substantially larger that diameter D2 of first assembly 176. Assembly 188 includes a cylindrical casing 192, auger 194 disposed therein and a cutting head 196 mounted on the leading end of auger 194 and rotatable therewith. Second swivel 190 includes an axially elongated cylindrical mounting insert 198 which is slidably received within the trailing end portion of casing 180 of segment 186B. More particularly, insert 198 is disposed within the interior cavity in which auger 34 is disposed and slidably engages the inner surface of casing 180 upon insertion therein. Auger 194 is mounted on drive 32 so that FIG. 8A shows machine 10 in preparation for boring a larger diameter hole than that of intermediate hole 184.

Figure 10:
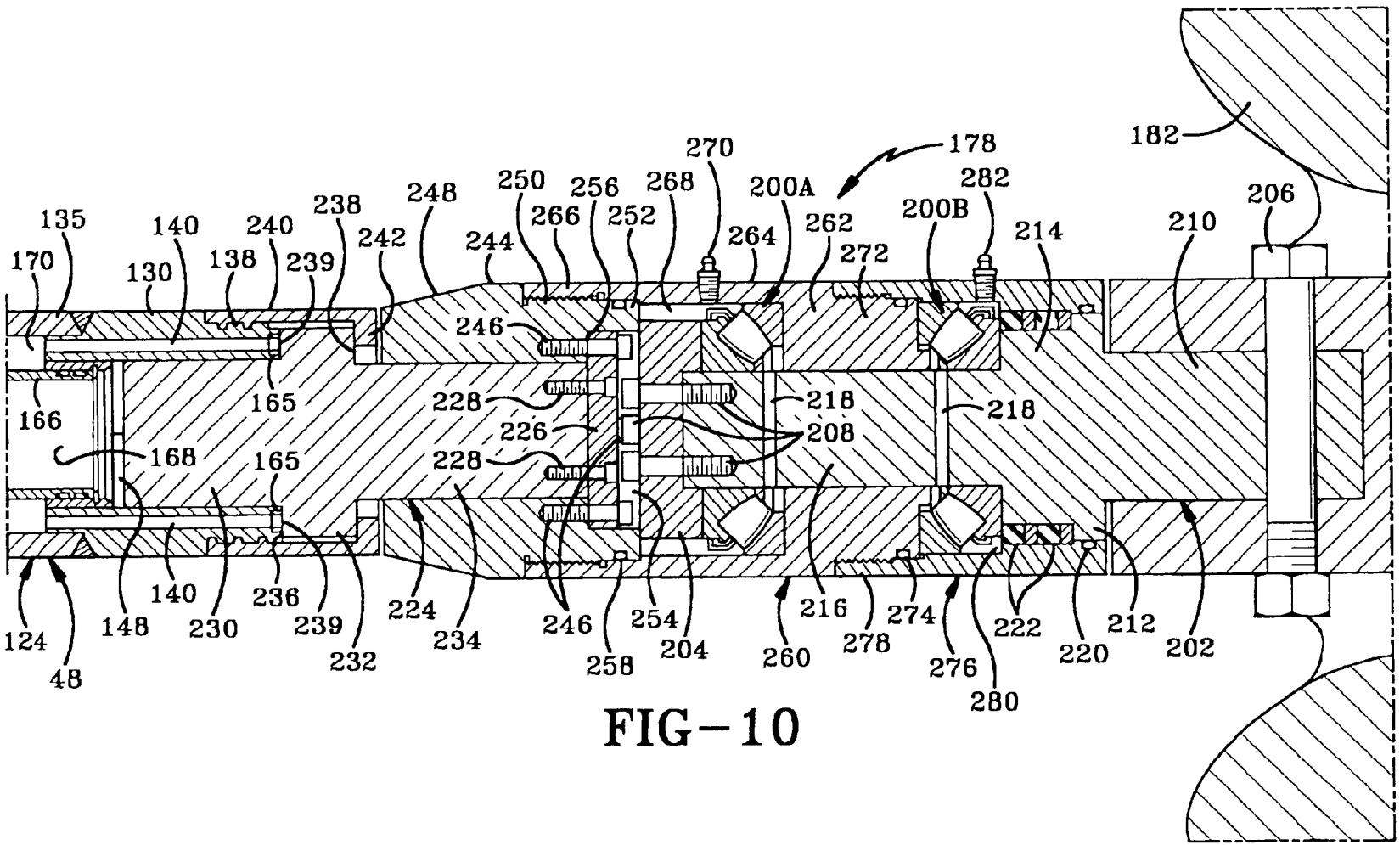
FIG. 10 is sectional view taken on line 10-10 of FIG. 8 showing the internal structure of the first swivel and connections with the pilot tube and smaller diameter cutting head.

Referring to FIG. 10, first swivel 178 and its connection to pilot tube 48 and auger assembly 176 is described in further detail. Swivel 178 has leading and trailing ends defining therebetween an axial direction thereof. Swivel 178 is configured to allow for the rotation of cutting head 182 and auger 34 independent of the movement of pilot tube 48 and typically without rotation of pilot tube 48. This is achieved primarily by the use of a pair of axially spaced annular thrust bearings 200A and 200B. Swivel 178 thus includes a rotatable portion or section which is mounted on and rotates with cutting head 182 relative to another portion or section of swivel 178 which is referred to herein as the non-rotating portion for simplicity. More particularly, the rotatable portion includes a main shaft 202 and a retaining flange or cap 204 mounted on the leading end of main shaft 202. Shaft 202 is mounted on cutting head 182 by a bolt 206 and nut threaded thereon. Cap 204 is secured to shaft 202 by a plurality of bolts 208 extending through holes formed in cap 204 and threadably engaging shaft 202. Shaft 202 includes a hexagonal or other non-circular projection 210 which extends rearwardly into a mating hexagonal or other non-circular opening formed in cutting head 182 and defines a hole through which bolt 206 passes. Shaft 202 steps outwardly from projection 10 to a cylindrical flange 212 at the leading end of projection 210, then steps inwardly to a cylindrical seal seat 214 and steps further inwardly to a forward cylindrical portion 216 forward of seal seat 214. Thrust bearings 200 circumscribe portion 216, abutting the cylindrical outer surface thereof. Bearing 200A abuts the trailing end of cap 204 and bearing 200B abuts the leading end of seat 214. Lubricant passages 218 are formed in forward portion 216 to allow movement of lubricant therethrough which is used in lubricating thrust bearings 200. A rearmost seal 220 abuts the outer cylindrical surface of flange 212, and a pair of seals 222 likewise abut the outer surface of seal seat 214 with one of seals 222 abutting the rear edge of thrust bearing 200B.

Swivel 178 also includes a non-rotating portion which is mounted on pilot tube 48. The non-rotatable portion includes a main shaft 224 and a mounting flange or cap 226 connected to the rear end thereof by a plurality of bolts 228 which threadably engage shaft 224. More particularly, shaft 224 includes a hexagonal or other non-circular forward projection 230 which is received in hexagonal or other non-circular opening 148 in a mating fashion therewith. Shaft 224 further includes an annular flange 232 extending radially outwardly from the trailing end of forward projection 230, and a rear projection 234 extending rearwardly from flange 232. Flange 232 has a leading or front end 236 and a trailing or rear end 238. Front end 236 engages seals 165 and the trailing end of pilot tube 48 when mounted thereon so that flange 232 serves as a pushing member for pushing pilot tube 48 during operation. Front end 236 thus completely covers entrance openings 239 at the trailing end of respective passages 140 on the outer surface of pilot tube 48. Swivel 178 further includes an internally threaded collar 240 which threadably engages threaded portion 138 of the rearmost coupling member 130 of pilot tube 48. Collar 240 has a cylindrical side wall and an annular flange 242 extending radially inwardly from the rear end of the cylindrical side wall. Flange 242 engages rear end 238 of flange 232 when swivel 178 is mounted on pilot tube 48. An annular wall 244 defines an interior chamber in which rear projection 234 is received. Wall 244 is secured to cap 226 by a plurality of bolts 246 which threadably engage wall 244. Wall 244 further includes a tapered section 248 which tapers rearwardly and radially outwardly from adjacent trailing end of collar 240. Wall 244 further includes an externally threaded portion 250 disposed rearwardly of section 248.

Wall 244 further includes an annular flange 252 extending rearwardly from threaded portion 250 and forming the trailing end of wall 244. Flange 252 defines therewithin a cavity which serves as a counter bore 254 in which mounting cap 226 is received in abutment with a rearwardly facing counter bore ledge 256 which bounds counter bore 254. The heads of bolts 246 and 208 are disposed within counter bore 254 with bolts 208 disposed radially inwardly of bolts 246 to prevent interference therebetween during rotation of cutting head 182 and the rotatable portion of swivel 178. An outwardly facing annular groove is formed in the outer surface of flange 252 for receiving therein an annular seal 258.

The non-rotating portion of swivel 178 further includes a central generally cup-shaped connecting member 260 which includes a base 262 and a cylindrical side wall 264 extending forward therefrom. Side wall 264 at the front thereof includes an internally threaded portion 266 which threadably engages threaded portion 250 to secure member 260 to annular wall 244 with an inner surface of side wall 264 abutting seal 258 to provide a seal between the two members. Member 260 defines an interior chamber 268 with which an externally accessible lubricant access port 270 communicates. The front of forward portion 216 and retaining cap 204 of the rotatable portion of swivel 178 are disposed within interior chamber 268 along with thrust bearing 200A. Base 262 includes an externally threaded portion 272 and defines an annular groove along its outer surface rearward of portion 272 for receiving therein an annular seal 274. The non-rotating portion of swivel 178 further includes a rear connecting member 276 comprising a substantially cylindrical side wall having an internally threaded portion 278 at the front thereof which threadably engages threaded portion 272 of central connecting member 260. The inner surface of connecting member 276 immediately behind threaded portion 278 abuts seal 274. An inwardly facing annular groove is formed in member 276 adjacent the rear end thereof for receiving therein seal 220. The inner surface of member 276 also abuts seals 222. The inner surface of connecting member 276 cooperates with the rear facing surface of base 262 of member 260, the forward facing surface of seal seat 214 and the outer circumference of forward portion 216 to define an annular interior chamber 280 in which thrust bearing 200B is disposed. An externally accessible lubricant access port 282 communicates with interior chamber 280.

Figure 12:
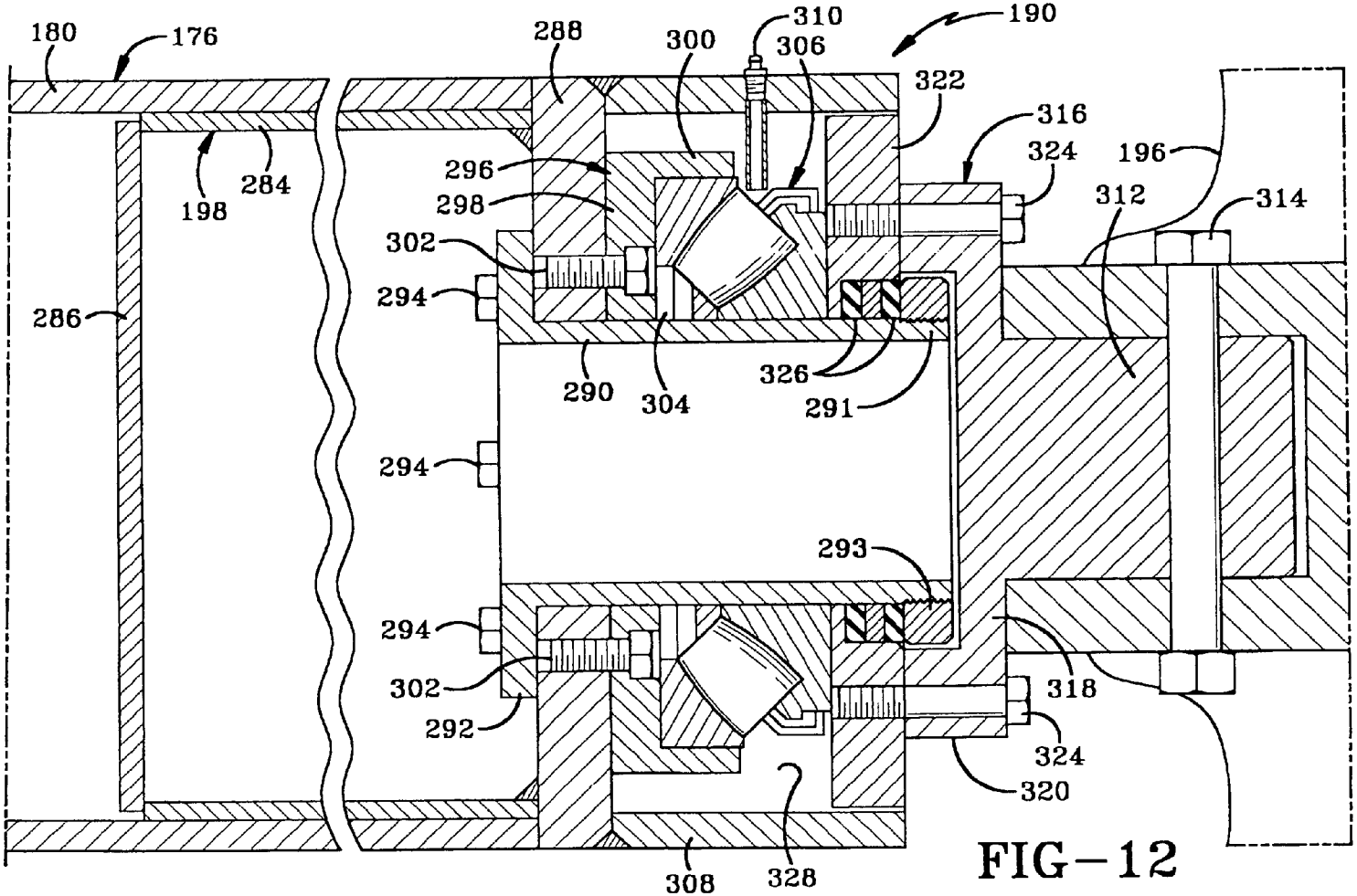
FIG. 12 is a sectional view taken on line 12-12 of FIG. 11 showing the internal structure of the second swivel and its connections with the smaller and larger diameter auger assemblies.

Referring to FIG. 12, second swivel 190 is described in further detail. Swivel 190 has leading and trailing ends defining therebetween an axial direction thereof. Swivel 190 includes a rotatable portion or section which is mounted on cutting head 196 and rotatable therewith relative to another portion or section of swivel 190 referred to herein as a non-rotating portion for simplicity. The non-rotating portion is mounted on casing 180 of auger assembly 176. Insert 198 is part of the non-rotating portion and includes a cylindrical side wall 284 and an end wall 286 connected to the front of side wall 284. Side wall 284 has an outer diameter substantially the same as that of auger 34. It is noted that the only connection between swivel 190 and the rearmost casing 180 is the simple insertion of insert 198 and abutment of pushing plate 288 against the trailing end of said casing 180. Thus, there are no fasteners extending between swivel 190 and casing 180 to connect swivel 190 to casing 180, nor other fasteners used in the connection. Insert 198 thus extends into the interior chamber of the rearmost casing 180 to provide sufficient stability to the connection. Slidable removal of insert 198 from within casing 180 involves no more than frictional engagement between the cylindrical outer surface of insert 198 and the cylindrical inner surface of casing 180.

A pushing member in the form of an annular pushing plate 288 is connected to the rear of side wall 284 and abuts the trailing edge of casing 180 along its outer perimeter. Plate 288 defines a central opening in which a cylindrical inner pipe 290 is disposed. Inner pipe 290 has a rear threaded portion 291 on which a nut 293 is threadably mounted. An annular flange 292 extends radially outwardly from the front end of inner pipe 290 and is mounted on plate 288 in abutment with the front surface thereof by a plurality of bolts 294. An annular cup 296 is disposed on the rear side of plate 288 and includes an annular base 298 and a cylindrical side wall 300 connected thereto and extending rearwardly therefrom. Cup 296 is connected to plate 288 by a plurality of bolts 302. Cup 296 defines therein a rearward facing cylindrical cavity 304 for receiving therein a portion of a thrust bearing 306. A cylindrical rear side wall 308 having the same outer diameter as casing 180 is connected to and extends rearwardly from plate 288. An externally accessible lubrication port 310 is mounted on side wall 308.

The rotating part of swivel 190 includes a hexagonal rear projection 312 which is received within a mating hexagonal opening of cutting head 196 and mounted thereon via a bolt 314 and nut mounted thereon. A cup-shaped portion 316 is connected to the front end of projection 312 and includes an annular base 318 which extends radially outwardly from projection 312 and an annular side wall 320 which extends forward from the outer perimeter of base 318. An annular seal plate 322 is connected to the front of side wall 320 by a plurality of bolts 324. Plates 322 defines a central opening in which a portion of inner pipe 290 is disposed immediately forward of threaded portion 291. Plate 322 along the center perimeter defines a rearwardly opening notch in which a pair of annular seals 326 are disposed in abutment with each of plate 322 and the outer surface of inner pipe 290. The rearward seal is also abutted by nut 293. An interior chamber 328 is defined by the inner surface of rear side wall 308 in cooperation with plates 288 and 322, annular cup 296 and the outer surface of pipe 290. Thrust bearing 306 is disposed in interior chamber 328 in abutment with plate 322, pipe 290 and cup-shaped member 296.

Figure 13:
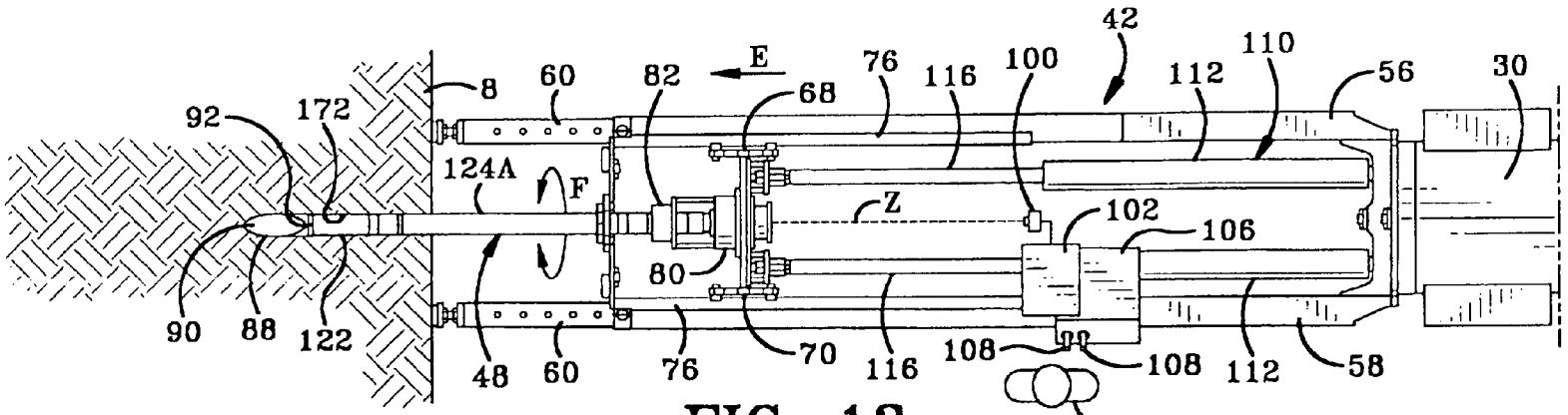
FIG. 13 is a top plan view of the drive mechanism showing an extension of the hydraulic actuators to provide an initial stage of pilot hole formation and also showing the steering capability of the pilot tube.
Figure 14:
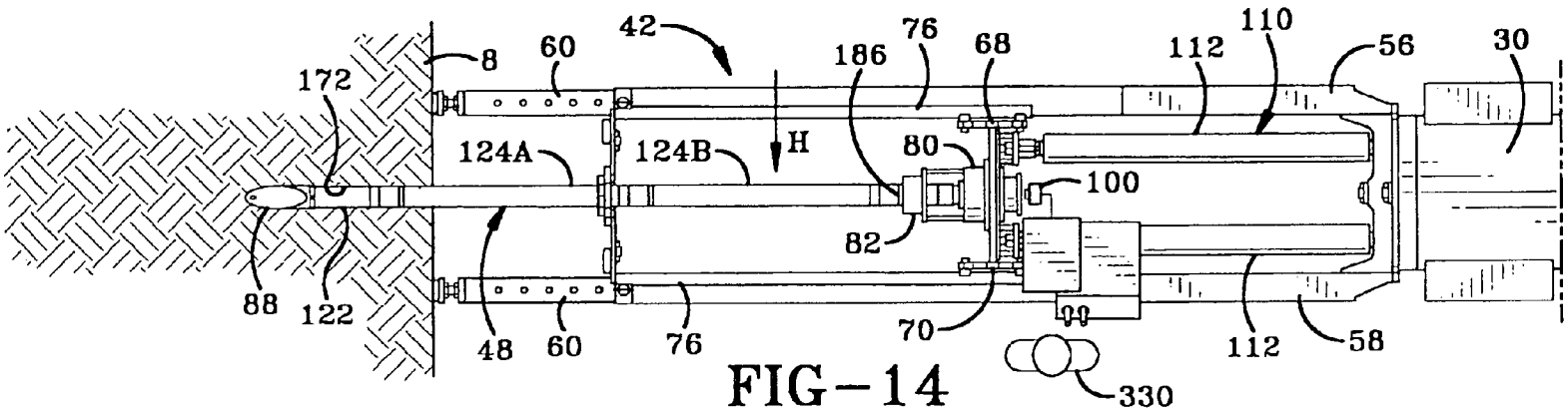
FIG. 14 is similar to FIG. 13 and shows the subsequent pilot tube segment connected to the previously driven pilot tube segment and the drive mechanism.
Figure 15:
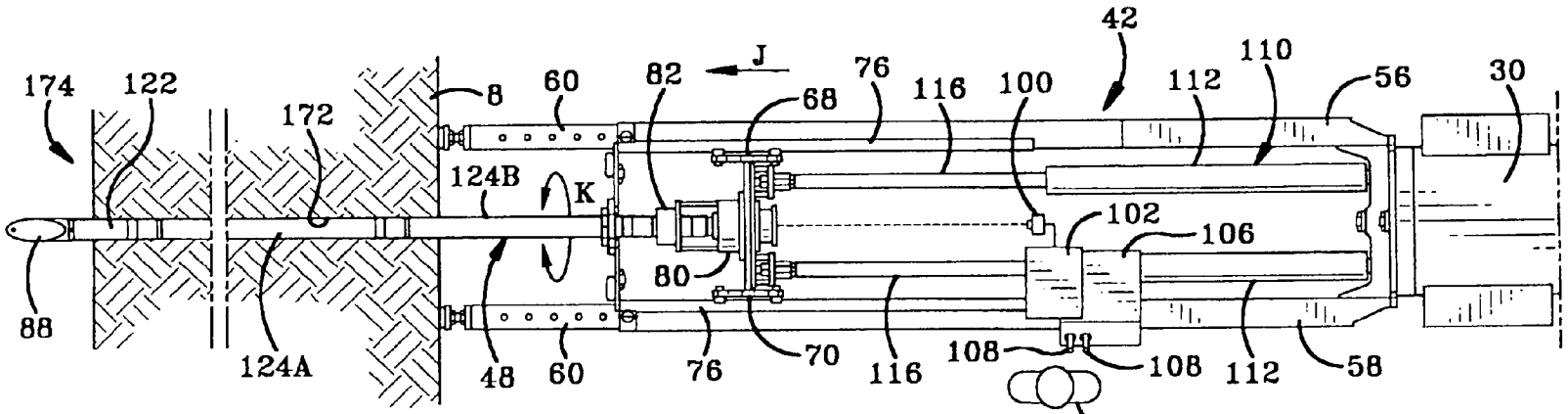
FIG. 15 is similar to FIG. 14 and shows the extension of the hydraulic actuators of the drive mechanism to drive the pilot tube with the newly installed pilot tube segment thereof to lengthen the pilot hole.

The operation of boring machine 10 is now described with reference to FIGS. 13-23. FIGS. 13-15 are shown without main frame 12 of machine 10 for simplicity. FIG. 13 shows assembly 42 in the process of driving of pilot tube 48 to form a pilot hole 172 with an operator 330 operating assembly 42. More particularly, pistons 116 are extended to drive pilot tube 48 into ground 8 as indicated at arrow E in FIG. 13. During the extension of pistons 116 and pilot tube 48, camera 100 senses or receives input from LED target 104 and relays the images of illuminations from target 104 to monitor 102. Operator 330 views display monitor 102 in order to determine whether steering head 88 needs to be adjusted to maintain the line and grade of pilot tube 48. Operator 330 will use controls 108 in order to make any necessary adjustments, specifically rotating pilot tube 48 as indicated at arrow F in FIG. 13 via motor 80. For use with longer pilot holes, machine 10 may include additional steering control mechanisms, as described in further detail in the copending application entitled Auger Boring Machine With Two-Stage Guidance Control System which is incorporated herein by referenced and filed concurrently herewith. Simultaneously with driving and steering pilot tube 48, water may be pumped through pilot tube 48 via swivel 82 to steering head 88 and through the exit openings thereof in order to facilitate the formation of pilot hole 206.

Once the initial driving of tube 48 is performed, pistons 112 are retracted and a pilot tube segment 124B is positioned and connected to tube segment 124A and rotatable portion 186 of swivel 82 as indicated at arrow H in FIG. 14 in preparation for additional driving of tube 48. Drive mechanism 110 is then operated to drive pilot tube 48 including segments 124A and B to lengthen pilot hole 172 as indicated at arrow J in FIG. 15 while operator 330 provides any rotational adjustment to steering head 88 as indicated at arrow K. The pattern of adding tube segments and continuing to drive pilot tube 48 goes on until the pilot hole is completed or more particularly so that the pilot tube 48 extends out of ground 8, as at pit 174, so that sections of pilot tube 48 may be removed as the auger boring operation is underway and thus moves pilot tube 48 gradually forward.

Figure 16:
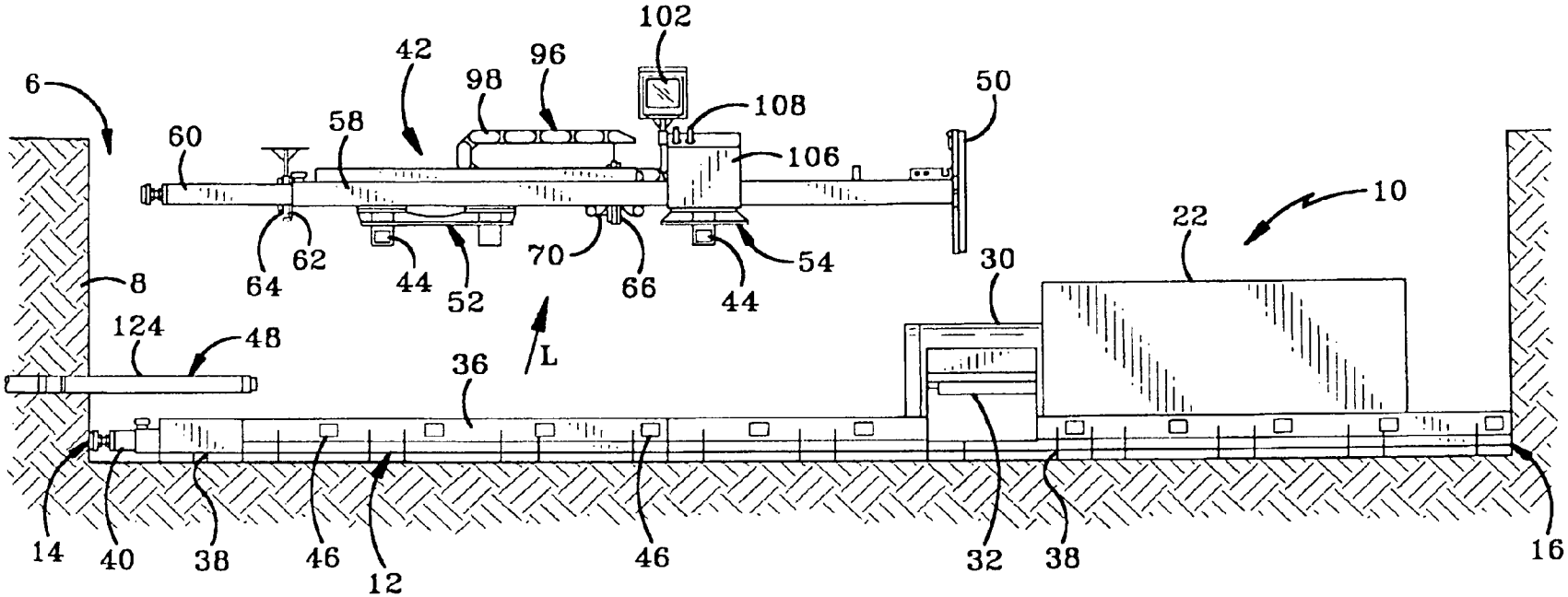
FIG. 16 is a side elevational view of the boring machine showing the pilot tube drive assembly being removed from the frame of the auger boring machine.
Figure 17:
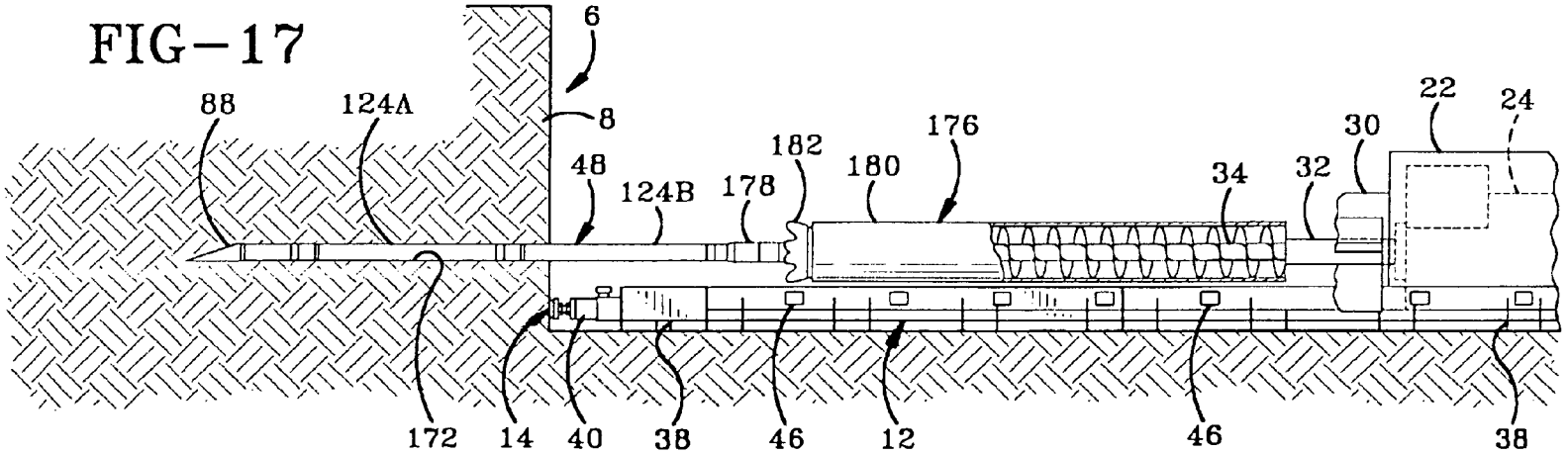
FIG. 17 is similar to FIG. 16 and shows the auger and first swivel connected to the smaller diameter auger assembly and pilot tube.
Figure 18:
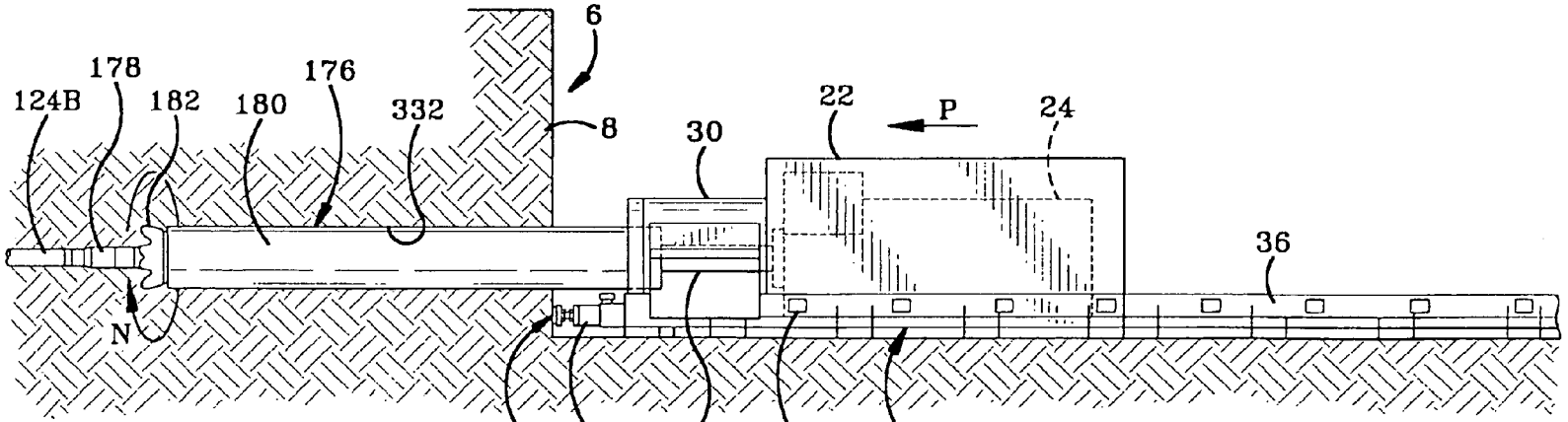
FIG. 18 is similar to FIG. 17 and shows the smaller auger assembly boring an intermediate diameter hole as it follows the pilot tube.
Figure 19:
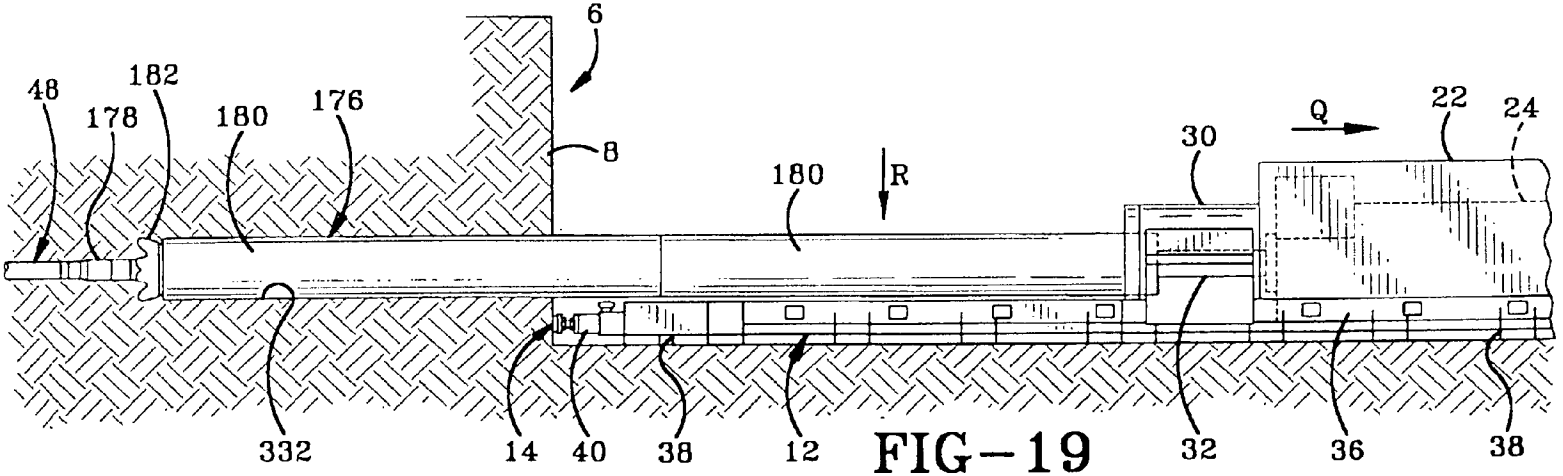
FIG. 19 is similar to FIG. 18 and shows a second segment of the smaller diameter auger assembly having been connected to the first segment and mounted on the auger drive.
Figure 20:
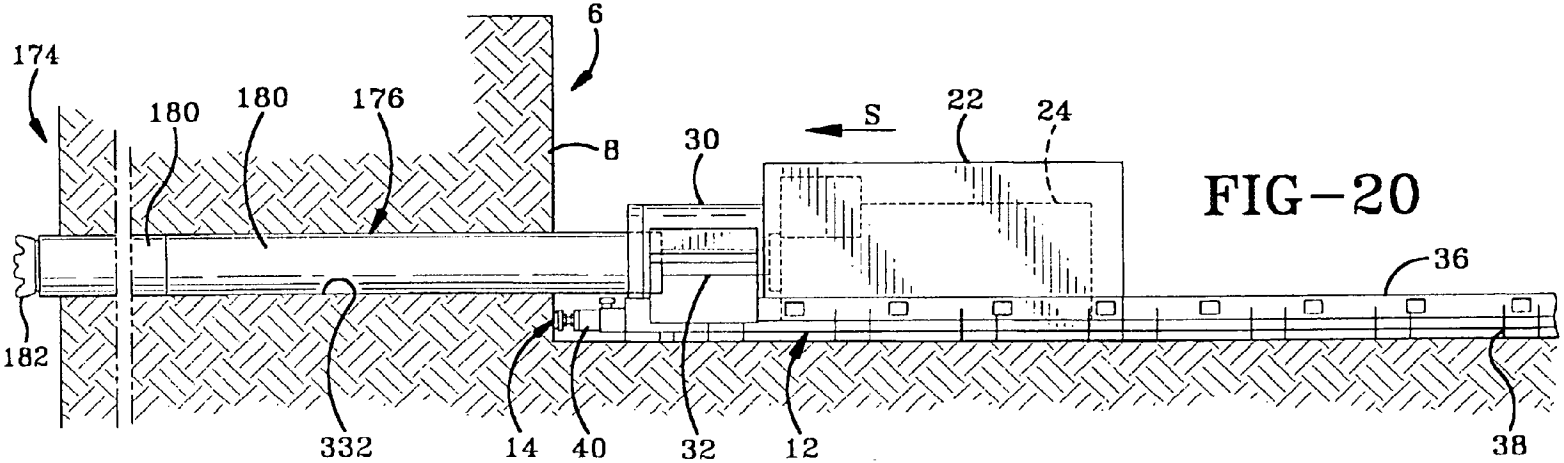
FIG. 20 is similar to FIG. 19 and shows additional boring with the subsequent segment of the smaller diameter auger assembly to lengthen the intermediate diameter hole.

Once pilot hole 206 is completed, assembly 42 is removed from frame 12 of auger boring machine 10 as indicated at arrow L in FIG. 16. As shown in FIG. 17, auger 34 is then connected to output shaft 32 along with the pipe or casing 180 in which auger 34 is disposed and cutting head 182 connected to the front of auger 34. Swivel 178 is also connected to the trailing end of pilot tube 48 and the front of cutting head 182 to allow for the rotation of auger 34 and cutting head 210 independently of and generally without rotating pilot tube 48. As shown in FIG. 18, engine 24 is then operated to rotate output shaft 32, auger 34 and cutting head 182 (arrow N) as engine 24 moves forward on rails 36 with auger 34 as indicated at arrow P to form a larger diameter hole 332 in which casing 180 will be disposed to form underground piping. Auger 34 carries soil displaced by cutting head 182 rearwardly to discharge from its trailing end so that it can be removed from pit 6. As shown in FIG. 19, engine 24 then moves rearwardly along rails 36 (Arrow Q) so that another casing 180 with auger 34 disposed therein is connected (Arrow R) to the previous casing 180 and auger 34 in end to end fashion to increase the length of the pipe to be laid, each casing 180 being welded to the subsequent casing 180. Once the additional casing 180 and auger 34 are connected, engine 24 is once again operated to rotate output shaft 32 and said augers to lengthen hole 332 as indicated at arrow S in FIG. 20. Additional casings 180 and augers 34 are connected and operated by engine 24 until casings 180 reach pit 174, where they are removed from one another and from pit 174.

Figure 21:
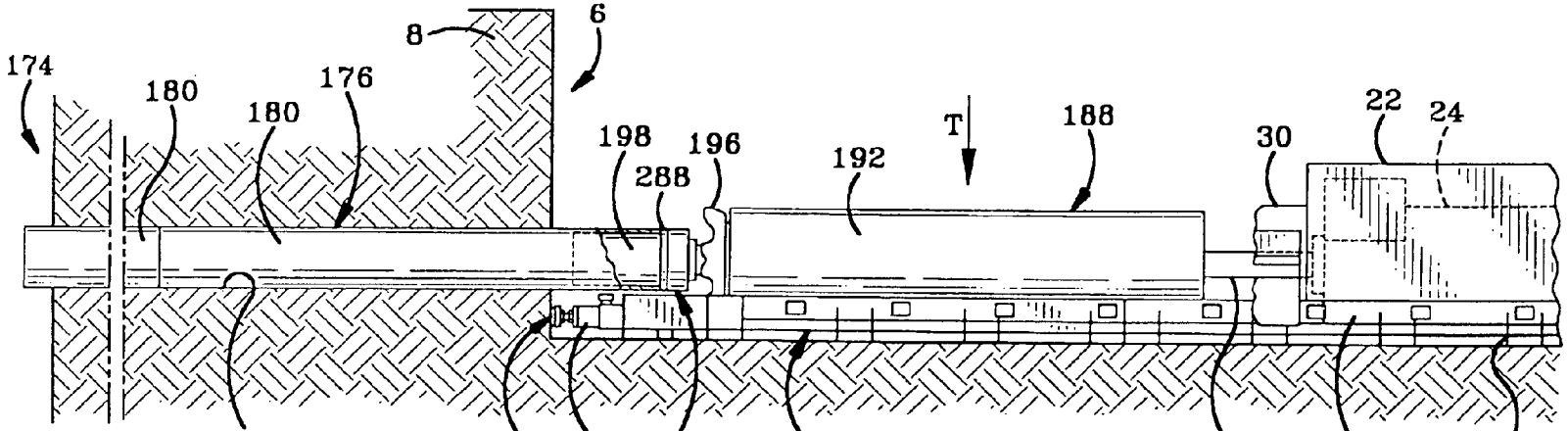
FIG. 21 is similar to FIG. 20 and shows the installation of the larger diameter auger assembly on the auger drive and on the smaller diameter auger assembly via the second swivel.
Figure 22:
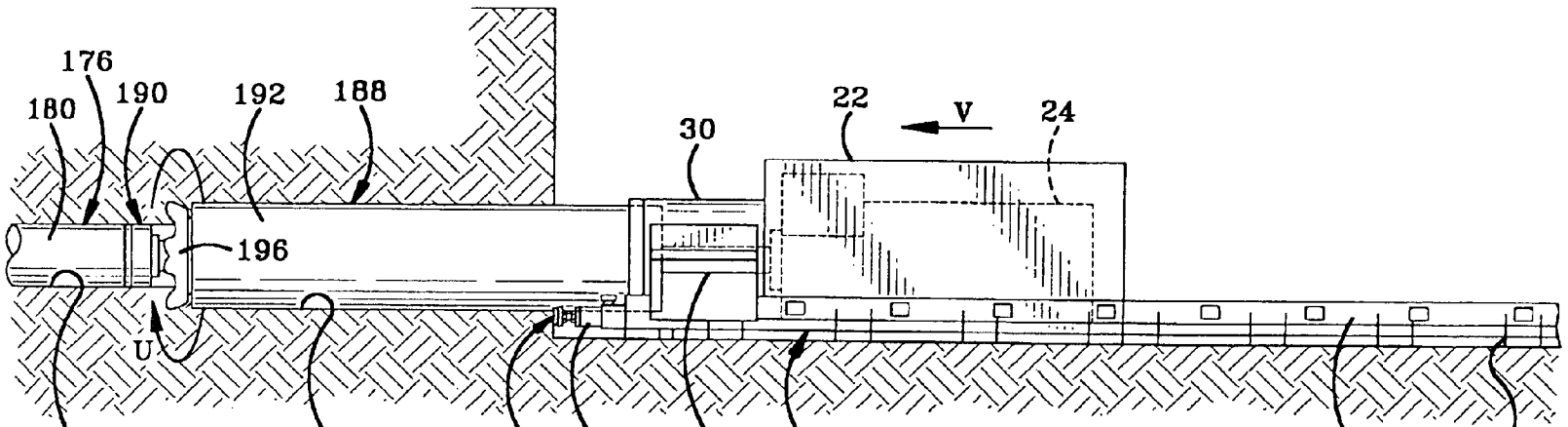
FIG. 22 is similar to FIG. 21 and shows the larger diameter auger assembly boring at an initial stage of the enlarged diameter hole in which the underground pipe will be disposed.
Figure 23:
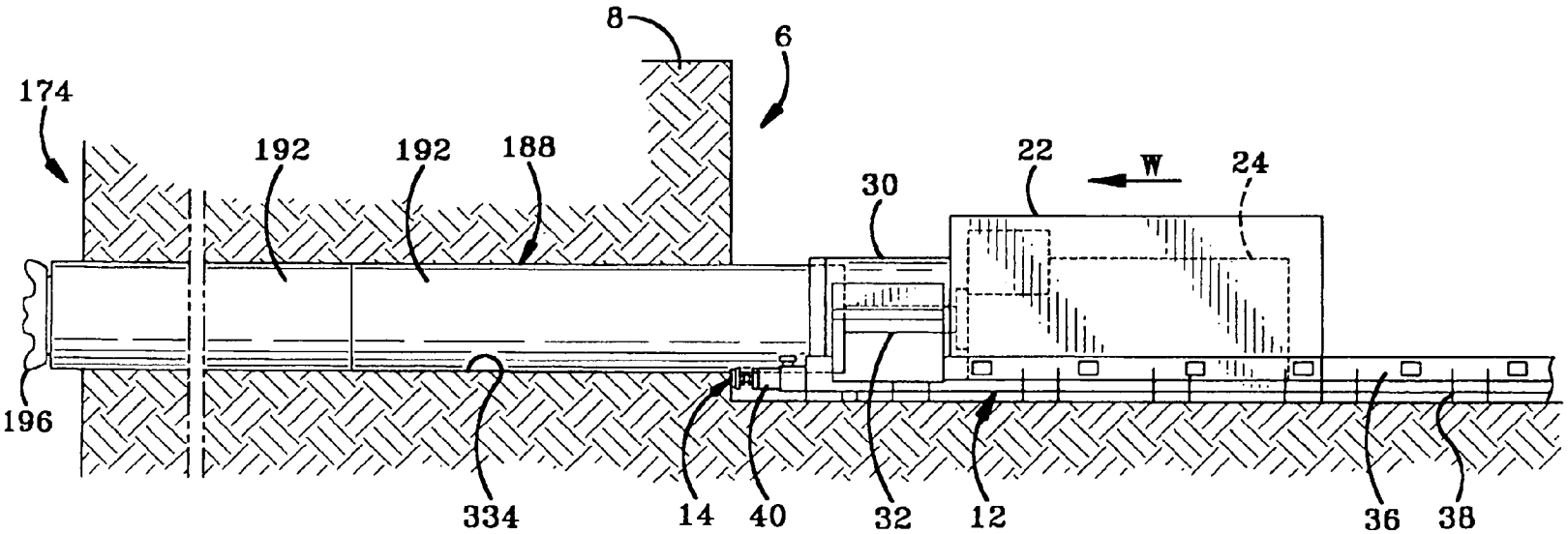
FIG. 23 is similar to FIG. 22 and shows the larger diameter hole completed with the pipe disposed therein.

As shown in FIG. 21, second auger assembly 188 is then connected to the rear of first auger assembly 176 (arrow T). More particularly, insert 198 is slidably inserted into the rear of the last of casings 180 so that pushing plate 288 abuts the trailing end thereof. Cutting head 196 is connected to second swivel 190 and auger 194 (not shown) is connected to output shaft 32. Referring to FIG. 22, engine 24 is then operated to rotate shaft 32, auger 194 and cutting head 196 (arrow U) to cut a hole 334 which is substantially larger than hole 332 as engine 24 and second auger assembly 188 move forward as indicated at arrow V. During the process of cutting hole 334, pushing plate 288 pushes against the trailing edge of rearmost casing 180 to push it through hole 332. Swivel 190 allows for the rotation of cutting head 196 and auger 194 independently of and without rotation of auger 34 within casing 180. As shown in FIG. 23, an additional casing segment 192 with an auger (not shown) disposed therein is connected to the rear of the first casing 192 with the auger connected to drive 32 and then advanced in the same manner as indicated at arrow W. Additional casings 192 and augers 194 are added in sequence and moved along to lengthen hole 334 until reaching pit 174, at which time casing segments 192 together form the final underground pipe. Cutting head 186 and augers 194 are then removed from within casing 192. It is noted that engine 24 serves as a single power source for operating augers 34 and 194 as well as for powering the drive mechanism of the pilot tube control and guidance assembly via generator 26 and hydraulic pump 28 (FIG. 2), as described in further detail in the copending application entitled Auger Boring Machine With Included Pilot Tube Steering Mechanism which is incorporated herein by referenced and filed concurrently herewith.

Figure 24:
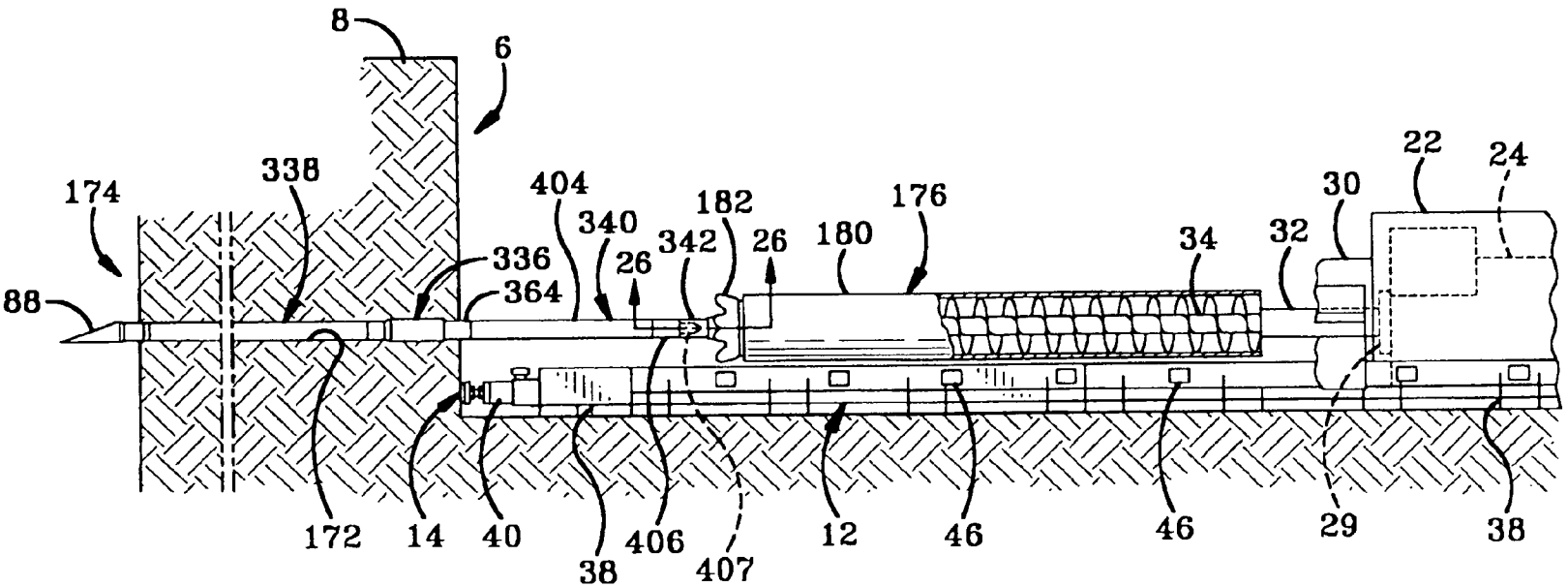
FIG. 24 is similar to FIG. 8 and shows the smaller diameter auger assembly mounted on a second embodiment of the pilot tube by a second embodiment of the first swivel and a shock rod.

Referring to FIG. 24, the second embodiment of the swivel 336 and associated structure is now described. Swivel 336 serves the same function as that of swivel 178 and is shown connected to the trailing end of a pilot tube segment 338 which is described in greater detail in the previously mentioned copending application entitled Lubricated Pilot Tubes for Use With Auger Boring Machine Pilot Steering System. While swivel 178 was shown connected directly to a coupler of a cutting head, swivel 336 is connected indirectly to the cutting head via connection with a shock rod 340 which is connected to the trailing end of swivel 336. In turn, shock rod 340 is connected to a cutting head coupler 342.

Referring to FIG. 25, swivel 336 and its associated connections are described in greater detail. The leading end of swivel 336 is connected to a coupling member 344 on the trailing end of pilot tube segment 338. Coupler member 344 includes an annular member 346 having an externally threaded section 348 adjacent its trailing end with a hexagonal cavity or passage 350 extending forward from its trailing end. Swivel 336 includes a front coupling member including an annular member 352 and an internally threaded collar 354 which is rotatably mounted thereon and threadedly engages threaded section 348 to connect swivel 336 to pilot tube segment 338. A hexagonal cavity 356 is formed in annular member 352. A hexagonal drive shaft 358 is disposed within hexagonal cavities 350 and 356 and has a mating configuration therewith in order to provide a torque drive therebetween. Swivel 336 includes a hexagonal projection 360 adjacent its trailing end which is matingly received within a front cavity 362 of an annular coupler 364 of shock rod 340. Front cavity 362 is shaped to provide for a driving torque engagement with projection 360. A connector pin 366 extends through respective holes formed in coupler 364 and projection 360 to connect the two and provide an additional torque connection.

With continued reference to FIG. 25, swivel 336 is further described. Swivel 336 includes first and second portions 368 and 370 which are mounted on and rotatable relative to one another via a plurality of angular contact bearing assemblies including a front annular bearing assembly 372 and six rear angular contact bearing assemblies 374. First portion 368 includes an annular member 352, a tapered member 376 rigidly connected to member 352 and an outer sleeve 378 connected to tapered member 376. Tapered member 376 includes an externally threaded portion 380 adjacent its trailing edge which threadedly engages an internally threaded leading portion 382 of outer sleeve 378 to provide the connection therebetween. Outer sleeve 378 steps inwardly at an annular flange 384 to provide a forward-facing surface or ledge 384 and a rearward-facing surface or ledge 386.

Second portion 370 includes projection 360, a cylindrical flange 388 extending outwardly from the leading end thereof and a cylindrical shaft 390 which is stepped inwardly from flange 388 and extends forward therefrom. A pair of annular seals 392 are disposed respectively in annular grooves formed in the cylindrical outer surface of flange 388 to provide a seal with the inner surface of outer sleeve 378. Flange 388 provides an annular forward-facing surface or ledge 394.

A retaining mechanism 396 or flange is connected adjacent the leading end of shaft 390 and abuts front contact bearing assembly 372 so that assembly 372 is sandwiched between the trailing end of mechanism 396 and ledge 384. Mechanism 396 may include a nut which threadedly engages the front of shaft 390 or may include a clip or other suitable connector or retaining structure to prevent rearward movement of second portion 370 relative to first portion 368.

Each of bearing assemblies 372 and 374 includes an inner ring 398, an outer ring 400 and a full complement of spherical ball bearings 402 disposed therebetween. Each of inner rings 398 abuts and rotates with shaft 390. Each of outer rings 400 abuts the cylindrical inner surface of sleeve 378 and rotates therewith. Ball bearings 402 thus provide for the rotatable relation between first and second portions 368 and 370. The inner ring 398 of front bearing assembly 372 abuts retaining mechanism 396 and the outer ring 400 thereof abuts ledge 384. The outer ring 400 of the leading rear bearing assembly 374 abuts ledge 386 while the inner ring 398 of the trailing or rearmost bearing assembly 374 abuts ledge 394. Bearing assemblies 374 are stacked in abutment with one another in order to handle the substantial thrust which occurs during operation of machine 10 as the cutter head which rotates second portion 370 of swivel 336 cuts through the soil and forces a pilot tube forward. This forward force is thus transmitted from pushing surface 394 to bearing assemblies 374 to first portion 368 via pushing surface 386 of flange 388. It is noted that only a single bearing assembly 372 is disposed forward of flange 388. If a rearward force were applied to move the pilot tube out of the pilot hole, additional assemblies 372 would typically be stacked ahead of flange 388 to handle the rearward thrust. However, as described below, this is not necessary with the present system.

Figure 26:
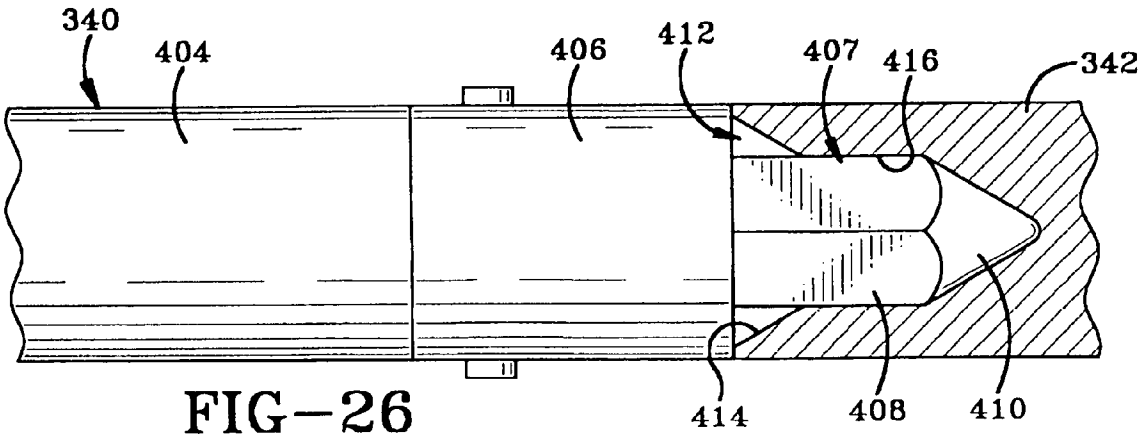
FIG. 26 is a sectional view taken on line 26-26 of FIG. 24 and shows the connection between the trailing shock rod coupler and the cutting head coupler.

Referring to FIG. 26, the connection between shock rod 340 and the smaller diameter auger assembly is described in greater detail. Shock rod 340 has a central section 404 and rear coupler 406 connected to the trailing end thereof. Coupler 406 includes a projection or insert 407 comprising a hexagonal section 408 and a conical section 410 connected to and extending rearwardly from section 408. Conical section 420 tapers rearwardly and inwardly to a point. A receiving cavity 412 is formed in coupler 342 and includes a leading tapered section 414 which tapers rearwardly and inwardly a short distance to an engaging section 416 of a mating configuration with hexagonal section 408 to provide for a torque drive connection. Section 416 may be hexagonal or another shape of mating configuration with hexagonal section 408. Insert 407 simply slides into cavity 412 of coupler 342 with no additional mechanism for making the connection between coupler 406 and 342. The inner surfaces of section 416 engage the outer surfaces of hexagonal section 408 to provide the torque drive connection between the couplers. However, there is no other engagement between the two couplers which prevents them from sliding apart if a suitable force is applied to move the two away from one another. Thus, there are no fasteners extending between coupler 406 and 342 to connect them.

Figure 27:
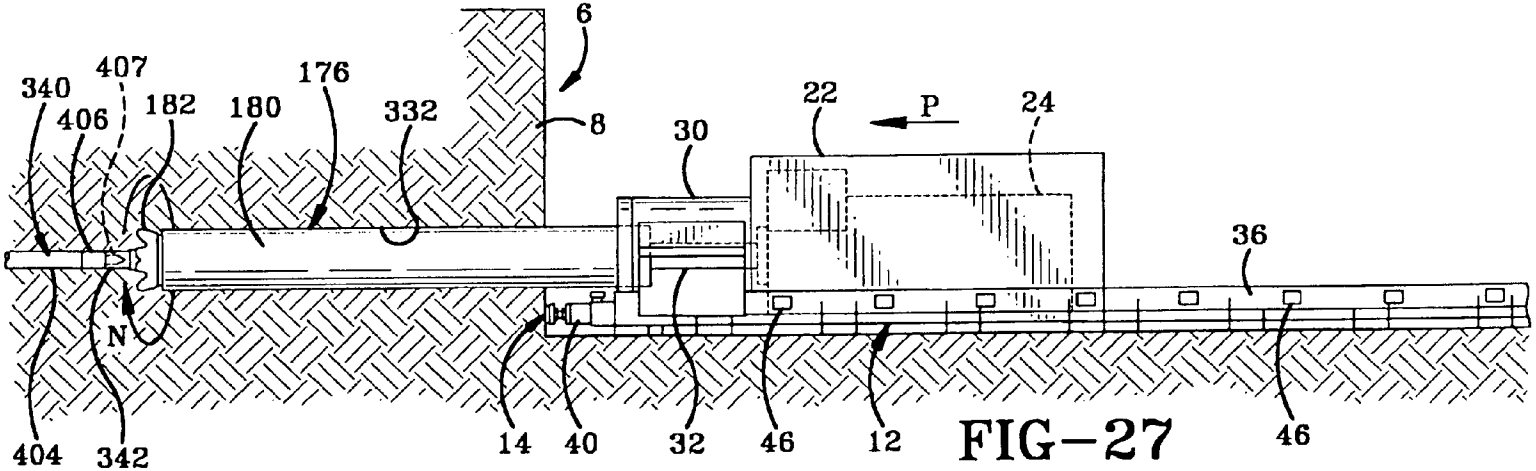
FIG. 27 is similar to FIG. 18 and shows a smaller auger assembly boring an intermediate diameter hole as it follows the second embodiment of the pilot tube, first swivel and shock rod.
Figure 28:
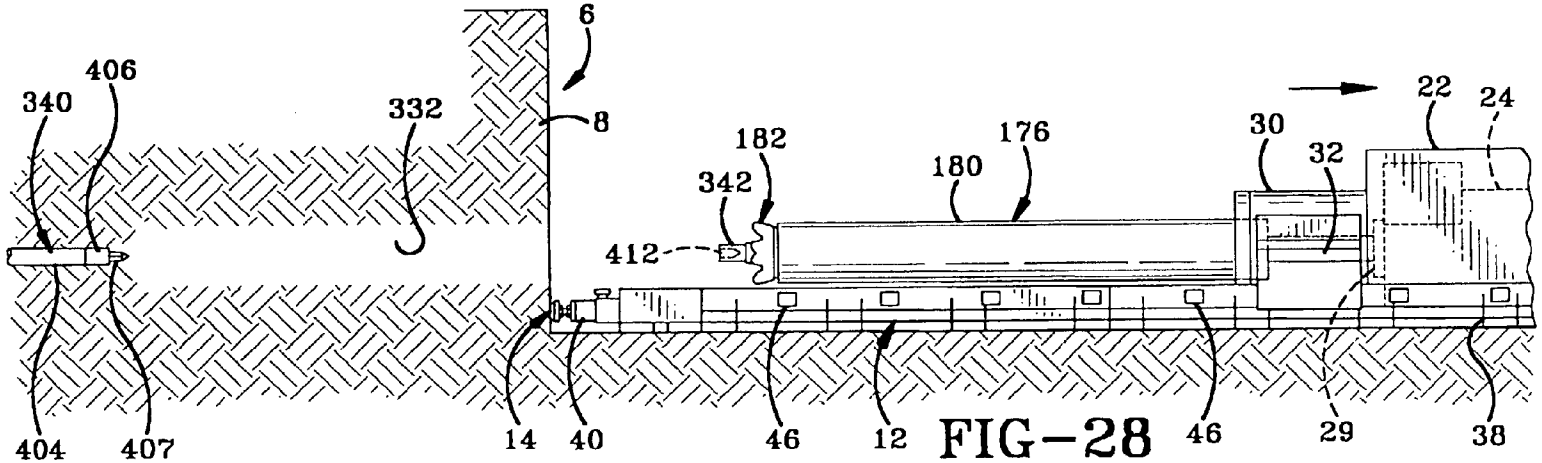
FIG. 28 is similar to FIG. 27 and shows the smaller auger assembly disconnected from the shock rod and removed from the intermediate diameter hole.

Referring to FIG. 27, the embodiments described with reference to FIGS. 24-26 are shown in use with auger assembly 176, which has bored into ground 8 to push the pilot tube ahead of it while swivel 336 allows further rotation of cutting head 182 independent of any rotation of the pilot tube. Should the cutting head of auger assembly 176 become stuck or damaged, it may be necessary to remove the cutting head for repair or replacement. As illustrated in FIG. 19, this is greatly simplified by the simple slide fit connection between coupler 406 and 342 whereby machine 10 is operated to move auger assembly 176 rearwardly out of the intermediate diameter hole cut thereby while leaving the pilot tube, swivel 336 and shock rod 340 within the pilot hole. As previously noted, the ability to leave these elements within the pilot hole eliminates the need for an increased number of front bearing assemblies 372 within swivel 336. In addition, this greatly facilitates the ability to repair or replace the cutting head of assembly 176. Without this simple disconnection between couplers 406 and 342, the entire pilot tube would have to be withdrawn from the pilot hole along with assembly 176 which would require a substantial amount of force and energy expended therefore. In addition, pilot tube segments which have previously been removed at pit 174 would have to be reconnected to the portion of the pilot tube remaining within the pilot hole to ensure that upon subsequent forward thrust of the pilot tube that it would be properly aligned within the pilot hole and not be damaged.

Thus, auger machine 10 provides for the driving of a pilot tube and subsequent connection of a swivel to the pilot tube to allow for the rotation of a cutting head and auger independent of the pilot tube in order to create a hole of increased diameter which follows the pilot hole. In addition, machine 10 provides a cutting head having a coupler which may be disconnected from the pilot tube while the pilot tube remains within the pilot hole so that the cutting head may be repaired or removed and replaced if necessary. Moreover, machine 10 provides a second swivel to allow for independent rotation of a larger diameter cutting head and auger independent of the smaller diameter auger. This configuration greatly facilitates the boring process in the laying of underground pipe, minimizing the force required in order to bore the related holes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a swivel comprising first and second sections mounted on one another with relative rotation therebetween;

the first section being adapted to mount on a first auger assembly comprising a first cutting head and a first auger mounted thereon; and the second section being adapted to mount on one of (a) a pilot tube which is configured when driven to form an underground pilot hole and which has a diameter smaller than that of the first auger assembly, and (b) a second auger assembly having a diameter larger than that of the first auger assembly and comprising a cylindrical casing, a second cutting head and a second auger mounted on the second cutting head and rotatably disposed in the casing;

wherein the second section is adapted to mount on the pilot tube; and further comprising an auger boring machine cutting head; and a torque drive connection comprising first and second couplers between the first section of the swivel and the cutting head; the first and second couplers being slidably connectable by movement toward one another in a first direction and slidably disconnectable by movement away from one another in a second direction opposite the first direction.

2. The apparatus of claim 1 further comprising a plurality of angular contact bearings in abutment with one another and carried by the first and second sections.

3. The apparatus of claim 1 further comprising one of a first thrust bearing and a first angular contact bearing carried by the first and second sections.

4. The apparatus of claim 3 further comprising:

an externally threaded portion on one of the first and second sections;

an annular sidewall on the one of the first and second sections;

an internally threaded portion on the first sidewall threadably engaging the externally threaded portion; and an interior chamber which houses the first bearing and is bounded by the annular sidewall.

5. The apparatus of claim 4 further comprising a shaft on the other of the first and second sections; and a flange connected to and extending radially outwardly from the shaft and bounding the interior chamber.

6. The apparatus of claim 3 further comprising:

an annular sidewall on one of the first and second sections;

a first flange connected to and extending radially inward from the annular sidewall;

a shaft on the other of the first and second sections;

a second flange connected to and extending radially outwardly from the shaft;

an interior chamber which houses the first bearing and is bounded by the annular sidewall, the shaft and the first and second flanges.

7. The apparatus of claim 1 wherein the apparatus comprises the pilot tube; the pilot tube has a trailing end; and the second section of the swivel is mounted on the pilot tube adjacent the trailing end of the pilot tube.

8. The apparatus of claim 7 wherein the pilot tube has an outer surface; further comprising at least one entrance opening formed on the outer surface adjacent the trailing end of the pilot tube; and at least one lubricant through passage formed in the pilot tube communicating with and extending forward from the at least one entrance opening; and wherein the second section of the swivel covers the at least one entrance opening.

9. The apparatus of claim 7 further comprising a pushing member on the second section abutting the trailing end of the pilot tube.

10. The apparatus of claim 9 further comprising a projection with a non-circular cross section extending forward from the pushing member; an opening formed in the pilot tube for slidably receiving therein the projection and having a non-circular cross section of mating configuration with the projection.

11. The apparatus of claim 7 further comprising a projection with a non-circular cross section on one of the pilot tube and the second section; an opening formed in the other of the pilot tube and second section for slidably receiving therein the projection and having a non-circular cross section of mating configuration with the projection.

12. The apparatus of claim 7 further comprising:

a projection on one of the pilot tube and the second section;

a first flange connected to and extending radially outwardly from the projection;

an externally threaded portion on one of the pilot tube and the second section;

a collar comprising an annular sidewall and a second flange extending radially inwardly therefrom and directly engaging the first flange; wherein the collar is rotatable relative to the projection and first flange;

an internally threaded portion on the annular sidewall threadably engaging the externally threaded portion; and a central through passage formed in the second flange in which the projection is disposed.

13. The apparatus of claim 1 wherein the first auger assembly comprises a first cylindrical casing in which the first auger is rotatably disposed.

14. The apparatus of claim 1 wherein the first and second couplers are slidably connectable by movement toward one another in a first direction and slidably disconnectable by movement away from one another in a second direction opposite the first direction when the pilot tube, swivel, couplers and cutting head are underground such that the pilot tube is in an underground pilot hole formed by the pilot tube and the first cutting head is in a larger diameter underground hole formed by the first cutting head wherein the larger diameter hole communicates with and has a diameter larger than that of the pilot hole.

15. The apparatus of claim 7 further comprising the first auger assembly, which comprises the first cutting head and the first auger mounted on the first cutting head; and wherein the first section of the swivel is mounted on the first auger assembly so that the first cutting head, first auger and first section of the swivel are rotatable together relative to the pilot tube and second section of the swivel.

16. The apparatus of claim 15 wherein the first auger assembly comprises a cylindrical casing in which the first auger is rotatably disposed.

17. The apparatus of claim 8 wherein the second section of the swivel covers the at least one entrance opening when mounted on the first auger assembly and the trailing end of the pilot tube to block fluid communication between the at least one entrance opening and the first cutting head.

18. The apparatus of claim 17 further comprising a seal adjacent the at least one entrance opening to facilitate blocking the fluid communication.

19. The apparatus of claim 18 wherein the seal is disposed within the at least one lubricant through passage.

20. The apparatus of claim 18 wherein the second section of the swivel abuts the seal to block the fluid communication.

21. The apparatus of claim 8 further comprising:

a projection on one of the pilot tube and the second section;

a first flange connected to and extending radially outwardly from the projection;

an externally threaded portion on one of the pilot tube and the second section;

a collar comprising an annular sidewall and a second flange extending radially inwardly therefrom and directly engaging the first flange; wherein the collar is rotatable relative to the projection and first flange;

an internally threaded portion on the annular sidewall threadably engaging the externally threaded portion; and a central through passage formed in the second flange in which the projection is disposed.

22. An apparatus comprising:

a swivel comprising first and second sections mounted on one another with relative rotation therebetween;

the first section being adapted to mount on a first auger assembly comprising a first cutting head and a first auger mounted thereon; and the second section being adapted to mount on one of (a) a pilot tube which is configured when driven to form an underground pilot hole and which has a diameter smaller than that of the first auger assembly, and (b) a second auger assembly having a diameter larger than that of the first auger assembly and comprising a cylindrical casing, a second cutting head and a second auger mounted on the second cutting head and rotatably disposed in the casing;

wherein the apparatus comprises the pilot tube; the pilot tube has a trailing end; the second section of the swivel is mounted on the pilot tube adjacent the trailing end of the pilot tube; and the pilot tube has an outer surface; further comprising at least one entrance opening formed on the outer surface adjacent the trailing end of the pilot tube; and at least one lubricant through passage formed in the pilot tube communicating with and extending forward from the at least one entrance opening; and wherein the second section of the swivel covers the at least one entrance opening.

23. The apparatus of claim 22 wherein the second section of the swivel covers the at least one entrance opening when mounted on the first auger assembly and the trailing end of the pilot tube to block fluid communication between the at least one entrance opening and the first cutting head.

24. The apparatus of claim 23 further comprising a seal adjacent the at least one entrance opening to facilitate blocking the fluid communication.

25. The apparatus of claim 24 wherein the seal is disposed within the at least one lubricant through passage.

26. The apparatus of claim 24 wherein the second section of the swivel abuts the seal to block the fluid communication.

27. The apparatus of claim 22 further comprising:

a projection on one of the pilot tube and the second section;

a first flange connected to and extending radially outwardly from the projection;

an externally threaded portion on one of the pilot tube and the second section;

a collar comprising an annular sidewall and a second flange extending radially inwardly therefrom and directly engaging the first flange; wherein the collar is rotatable relative to the projection and first flange;

an internally threaded portion on the annular sidewall threadably engaging the externally threaded portion; and a central through passage formed in the second flange in which the projection is disposed.

28. The apparatus of claim 22 further comprising the first auger assembly, which comprises the first cutting head and the first auger mounted on the first cutting head; and wherein the first section of the swivel is mounted on the first auger assembly so that the first cutting head, first auger and first section of the swivel are rotatable together relative to the pilot tube and second section of the swivel.

29. The apparatus of claim 28 wherein the first auger assembly comprises a cylindrical casing in which the first auger is rotatably disposed.

30. An apparatus comprising:

a swivel comprising first and second sections mounted on one another with relative rotation therebetween;

the first section being adapted to mount on a first auger assembly comprising a first cutting head and a first auger mounted thereon; and the second section being adapted to mount on one of (a) a pilot tube which is configured when driven to form an underground pilot hole and which has a diameter smaller than that of the first auger assembly, and (b) a second auger assembly having a diameter larger than that of the first auger assembly and comprising a cylindrical casing, a second cutting head and a second auger mounted on the second cutting head and rotatably disposed in the casing;

wherein the apparatus comprises the pilot tube; the pilot tube has a trailing end; and the second section of the swivel is mounted on the pilot tube adjacent the trailing end of the pilot tube; and further comprising a projection on one of the pilot tube and the second section;

a first flange connected to and extending radially outwardly from the projection;

an externally threaded portion on one of the pilot tube and the second section;

a collar comprising an annular sidewall and a second flange extending radially inwardly therefrom and directly engaging the first flange; wherein the collar is rotatable relative to the projection and first flange;

an internally threaded portion on the annular sidewall threadably engaging the externally threaded portion; and a central through passage formed in the second flange in which the projection is disposed.

31. The apparatus of claim 30 further comprising the first auger assembly, which comprises the first cutting head and the first auger mounted on the first cutting head; and wherein the first section of the swivel is mounted on the first auger assembly so that the first cutting head, first auger and first section of the swivel are rotatable together relative to the pilot tube and second section of the swivel.

32. The apparatus of claim 31 wherein the first auger assembly comprises a cylindrical casing in which the first auger is rotatably disposed.

* * * * *